US010066467B2

(12) United States Patent
Getzlaf et al.

(10) Patent No.: US 10,066,467 B2
(45) Date of Patent: Sep. 4, 2018

(54) ELECTRICALLY ACTUATED DOWNHOLE FLOW CONTROL APPARATUS

(71) Applicant: NCS Multistage Inc., Calgary (CA)

(72) Inventors: Don Getzlaf, Calgary (CA); John Ravensbergen, Calgary (CA); Brock Gillis, Calgary (CA)

(73) Assignee: NCS Multistage Inc., Calgary (CA)

( * ) Notice: Subject to any disclaimer, the term of this patent is extended or adjusted under 35 U.S.C. 154(b) by 87 days.

(21) Appl. No.: 15/068,282

(22) Filed: Mar. 11, 2016

(65) Prior Publication Data

US 2016/0265310 A1 Sep. 15, 2016

Related U.S. Application Data

(60) Provisional application No. 62/132,241, filed on Mar. 12, 2015, provisional application No. 62/160,282, filed on May 12, 2015.

(51) Int. Cl.

| | |
|---|---|
| ***E21B 34/10*** | (2006.01) |
| ***E21B 47/06*** | (2012.01) |
| ***E21B 43/12*** | (2006.01) |
| ***E21B 34/06*** | (2006.01) |

(52) U.S. Cl.
CPC ..... *E21B 43/12* (2013.01); *E21B 34/066* (2013.01)

(58) Field of Classification Search
CPC ..... E21B 43/12; E21B 34/066
See application file for complete search history.

(56) References Cited

U.S. PATENT DOCUMENTS

| | | | |
|---|---|---|---|
| 4,367,794 | A | 1/1983 | Bednar et al. |
| 4,510,995 | A | 4/1985 | Krause, Jr. et al. |
| 4,550,780 | A | 11/1985 | Mott |
| 4,583,591 | A | 4/1986 | Krause, Jr. et al. |
| 4,667,736 | A | 5/1987 | Rumbaugh et al. |
| 4,796,699 | A | 1/1989 | Upchurch |

(Continued)

FOREIGN PATENT DOCUMENTS

| | | |
|---|---|---|
| CA | 2337030 C | 1/2005 |
| CA | 2210028 C | 3/2005 |

(Continued)

OTHER PUBLICATIONS

WIPO, International Search Report and Written Opinion for PCT Application No. PCT/CA2016/000068 dated May 18, 2016.

(Continued)

*Primary Examiner* — D. Andrews
*Assistant Examiner* — Yanick A Akaragwe
(74) *Attorney, Agent, or Firm* — Ridout & Maybee LLP

(57) ABSTRACT

There is provided a flow control apparatus including a housing, a port, a flow control member, a sensor, and a trigger. The housing includes a housing passage. The port extends through the housing. The flow control member includes a fluid responsive surface, and is configured for displacement, relative to the port, such that fluid communication is effected between the port and the housing passage. The sensor is coupled to the housing for sensing an actuating signal. The trigger is configured for effecting fluid communication between the housing passage and the fluid responsive surface, in response to the sensing of an actuating signal by the sensor, for effecting displacement of the flow control member.

92 Claims, 12 Drawing Sheets

(56) References Cited

U.S. PATENT DOCUMENTS

| | | | |
|---|---|---|---|
| 4,862,964 | A | 9/1989 | George et al. |
| 5,230,383 | A | 7/1993 | Pringle et al. |
| 5,273,112 | A | 12/1993 | Schultz |
| 5,691,712 | A | 11/1997 | Meek et al. |
| 5,819,854 | A | 10/1998 | Doane et al. |
| 5,975,204 | A | 11/1999 | Tubel et al. |
| 5,979,561 | A | 11/1999 | Edwards et al. |
| 6,021,095 | A | 2/2000 | Tubel et al. |
| 6,172,614 | B1 | 1/2001 | Robison et al. |
| 6,182,764 | B1 | 2/2001 | Vaynshteyn |
| 6,220,355 | B1 | 4/2001 | French |
| 6,283,227 | B1 | 9/2001 | Lerche et al. |
| 6,349,772 | B2 | 2/2002 | Mullen et al. |
| 6,382,234 | B1 | 5/2002 | Birckhead et al. |
| 6,414,905 | B1 | 7/2002 | Owens et al. |
| 6,450,263 | B1 | 9/2002 | Schwendemann |
| 6,464,006 | B2 | 10/2002 | Womble |
| 6,536,529 | B1 | 3/2003 | Kerr et al. |
| 6,550,538 | B1 | 4/2003 | Herrmann et al. |
| 6,584,406 | B1 | 6/2003 | Harmon et al. |
| 6,604,584 | B2 | 8/2003 | Lerche et al. |
| 6,679,332 | B2 | 1/2004 | Vinegar et al. |
| 6,920,085 | B2 | 7/2005 | Finke et al. |
| 7,025,134 | B2 | 4/2006 | Byrd et al. |
| 7,325,616 | B2 | 2/2008 | Lopez de Cardenas et al. |
| 7,347,278 | B2 | 3/2008 | Lerche et al. |
| 7,348,893 | B2 | 3/2008 | Huang et al. |
| 7,400,263 | B2 | 7/2008 | Snider et al. |
| 7,493,962 | B2 | 2/2009 | Sheffield |
| 7,503,398 | B2 | 3/2009 | LoGiudice et al. |
| 7,562,712 | B2 | 7/2009 | Cho et al. |
| 7,597,151 | B2 | 10/2009 | Curtis et al. |
| 7,640,989 | B2 | 1/2010 | Williamson, Jr. et al. |
| 7,661,478 | B2 | 2/2010 | Palmer et al. |
| 7,673,680 | B2 | 3/2010 | Buyers et al. |
| 7,802,627 | B2 | 9/2010 | Hofman et al. |
| 7,849,925 | B2 | 12/2010 | Patel |
| 7,854,267 | B2 | 12/2010 | Smith et al. |
| 7,963,342 | B2 | 6/2011 | George |
| 8,006,952 | B2 | 8/2011 | Wygnanski |
| 8,151,904 | B2 | 4/2012 | Krueger et al. |
| 8,157,022 | B2 | 4/2012 | Bertoja et al. |
| 8,215,411 | B2 | 7/2012 | Flores et al. |
| 8,267,178 | B1 | 9/2012 | Sommers et al. |
| 8,297,367 | B2 | 10/2012 | Chen et al. |
| 8,322,426 | B2 | 12/2012 | Wright et al. |
| 8,451,137 | B2 | 5/2013 | Bonavides et al. |
| 8,573,311 | B2 | 11/2013 | Zhao et al. |
| 8,646,537 | B2 | 2/2014 | Tips et al. |
| 8,684,084 | B2 | 4/2014 | Wesson et al. |
| 8,739,879 | B2 | 6/2014 | King |
| 8,757,265 | B1 | 6/2014 | Cuffe et al. |
| 8,757,273 | B2 | 6/2014 | Themig et al. |
| 8,783,365 | B2 | 7/2014 | McCoy et al. |
| 8,905,139 | B2 | 12/2014 | Arizmendi, Jr. et al. |
| 9,010,442 | B2 | 4/2015 | Streich et al. |
| 9,010,447 | B2 | 4/2015 | Themig et al. |
| 9,016,388 | B2 | 4/2015 | Kellner et al. |
| 9,051,810 | B1 | 6/2015 | Cuffe et al. |
| 9,121,250 | B2 | 9/2015 | Godfrey et al. |
| 9,194,210 | B2 | 11/2015 | Williamson, Jr. |
| 9,297,241 | B2 | 4/2016 | Arabskyy |
| 9,316,091 | B2 | 4/2016 | Symms |
| 9,359,859 | B2 | 6/2016 | Ross et al. |
| 9,428,989 | B2 | 8/2016 | Aitken et al. |
| 9,428,992 | B2 | 8/2016 | Merron |
| RE46,137 | E | 9/2016 | Jason et al. |
| 9,441,440 | B2 | 9/2016 | Hofman et al. |
| 9,453,388 | B2 | 9/2016 | Tahoun et al. |
| 9,476,282 | B2 | 10/2016 | Anton et al. |
| 9,488,035 | B2 | 11/2016 | Crowley et al. |
| 9,506,321 | B2 | 11/2016 | Cast |
| 9,534,484 | B2 | 1/2017 | Wright et al. |
| 9,650,866 | B2 | 5/2017 | George et al. |
| 9,670,750 | B2 | 6/2017 | Chauffe |
| 9,677,370 | B2 | 6/2017 | Richards et al. |
| 9,702,221 | B2 | 7/2017 | Hofman et al. |
| 9,856,411 | B2 | 1/2018 | Sadana et al. |
| 2003/0029611 | A1 | 2/2003 | Owens |
| 2007/0204995 | A1 | 9/2007 | Hofman et al. |
| 2007/0235199 | A1 | 10/2007 | LoGiudice et al. |
| 2008/0078553 | A1* | 4/2008 | George ..... E21B 34/063 166/332.8 |
| 2008/0302538 | A1 | 12/2008 | Hofman |
| 2009/0090501 | A1 | 4/2009 | Hansen et al. |
| 2009/0151790 | A1 | 6/2009 | Ranjan et al. |
| 2010/0314562 | A1 | 12/2010 | Bisset |
| 2011/0056679 | A1 | 3/2011 | Rytlewski |
| 2012/0061095 | A1 | 3/2012 | Capderou |
| 2012/0138311 | A1 | 6/2012 | Stout |
| 2012/0181032 | A1 | 7/2012 | Naedler et al. |
| 2013/0080063 | A1 | 3/2013 | Pillai et al. |
| 2013/0199800 | A1 | 8/2013 | Kellner et al. |
| 2014/0034310 | A1 | 2/2014 | Andersen |
| 2014/0083689 | A1 | 3/2014 | Streich et al. |
| 2014/0102708 | A1 | 4/2014 | Purkis et al. |
| 2014/0130893 | A1 | 5/2014 | Harested et al. |
| 2014/0151054 | A1 | 6/2014 | Norrid |
| 2014/0182856 | A1 | 7/2014 | Gano et al. |
| 2014/0246208 | A1 | 9/2014 | Themig et al. |
| 2014/0299330 | A1 | 10/2014 | Fripp et al. |
| 2015/0075791 | A1 | 3/2015 | Sommers |
| 2015/0107829 | A1 | 4/2015 | Themig |
| 2015/0129205 | A1 | 5/2015 | Hofman et al. |
| 2015/0204164 | A1 | 7/2015 | Themig et al. |
| 2015/0322747 | A1 | 11/2015 | Kasperski |
| 2016/0177673 | A1 | 6/2016 | Merron et al. |
| 2016/0208571 | A1 | 7/2016 | Themig et al. |
| 2016/0208579 | A1 | 7/2016 | Delzell et al. |
| 2016/0222759 | A1 | 8/2016 | Aldridge et al. |
| 2016/0230504 | A1 | 8/2016 | Walton et al. |
| 2016/0230505 | A1 | 8/2016 | Garcia et al. |
| 2016/0281464 | A1 | 9/2016 | Hulsewe et al. |
| 2017/0175487 | A1 | 6/2017 | Marcin et al. |

FOREIGN PATENT DOCUMENTS

| | | | |
|---|---|---|---|
| CA | 2450408 | C | 10/2005 |
| CA | 2236944 | C | 12/2005 |
| CA | 2491444 | C | 9/2006 |
| CA | 2393504 | C | 9/2007 |
| CA | 2541489 | C | 8/2009 |
| CA | 2471067 | C | 4/2010 |
| CA | 2837180 | A1 | 1/2013 |
| CA | 2791214 | C | 5/2014 |
| CA | 2915601 | A1 | 6/2017 |
| WO | 2007003597 | A1 | 1/2007 |
| WO | 2013109287 | A1 | 7/2013 |
| WO | 2013154420 | A1 | 10/2013 |
| WO | 2014046841 | A2 | 3/2014 |
| WO | 2014060722 | A2 | 4/2014 |
| WO | 2015060809 | A1 | 4/2015 |
| WO | 2015110486 | A1 | 7/2015 |
| WO | 2016020523 | A2 | 2/2016 |
| WO | 2016073006 | A1 | 5/2016 |
| WO | 2016204768 | A1 | 12/2016 |
| WO | 2017027978 | A1 | 2/2017 |

OTHER PUBLICATIONS

Canadian Examiner's Report, Application No. 2,923,662, dated Mar. 23, 2018.

* cited by examiner

ELECTRICALLY ACTUATED DOWNHOLE FLOW CONTROL APPARATUS

FIELD

The present disclosure relates to flow control apparatuses which are deployable downhole for controlling supply of treatment fluid to the reservoir and for controlling production of reservoir fluids from the reservoir.

BACKGROUND

Mechanical actuation of downhole valves can be relatively difficult, owing to the difficulty in deploying shifting tools on coiled tubing, or conventional ball drop systems, for actuating such valves, especially in deviated wellbores. This is especially the case with respect to so-called "toe valves" or "toe sleeves", which are disposed at, or close to, the furthest end of the wellbore. Toe valves are used to enable pressure dissipation, after pressure testing of a well and prior to completion, so that guns and/or balls may be pumped down.

BRIEF DESCRIPTION OF DRAWINGS

The preferred embodiments will now be described with the following accompanying drawings, in which.

SUMMARY

There is provided a flow control apparatus including a housing, a port, a flow control member, a sensor, and a trigger. The housing includes a housing passage. The port extends through the housing. The flow control member includes a fluid responsive surface, and is configured for displacement, relative to the port, such that fluid communication is effected between the port and the housing passage. The sensor is coupled to the housing for sensing an actuating signal. The trigger is configured for effecting fluid communication between the housing passage and the fluid responsive surface, in response to the sensing of an actuating signal by the sensor, for effecting displacement of the flow control member.

There is also provided a flow control apparatus including a housing, a port, a flow control member, a sensor, a valve, and a valve actuator. The housing includes a housing passage. The port extends through the housing. The flow control member includes a fluid responsive surface, and is configured for displacement, relative to the port, such that fluid communication is effected between the port and the housing passage. The sensor is coupled to the housing for sensing an actuating signal. The valve includes a communication sealing surface for effecting sealing, or substantial sealing, of fluid communication between the housing passage and the fluid responsive surface. The valve actuator is responsive to sensing of the actuating signal by the sensor, for effecting a change in condition of the valve such that the communication sealing surface becomes displaceable relative to the housing such that fluid communication between the housing passage and the fluid responsive surface is effectible.

In one aspect, the flow control apparatus is integrated within a wellbore string that is disposed downhole within a wellbore. In another aspect, a system is provided including the wellbore string having the flow control apparatus integrated therein, and also including a seismic source disposed at the surface for generating the actuating signal.

DETAILED DESCRIPTION

Figure 14:
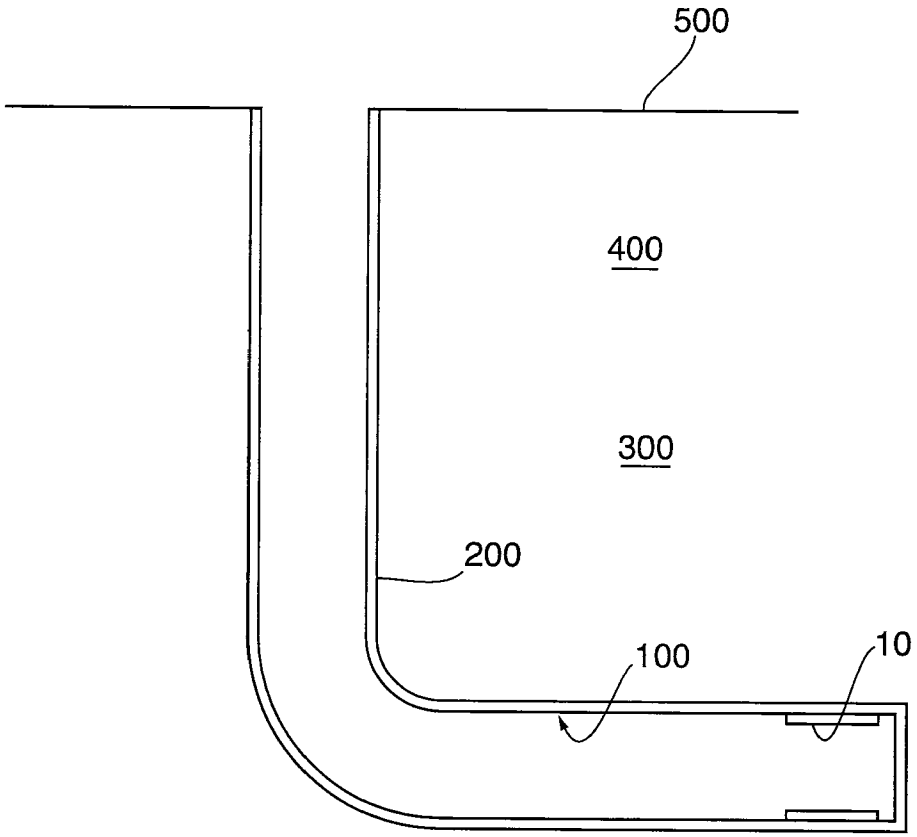
FIG. 14 is a schematic illustration of the incorporation of the flow control apparatus of any one of the embodiments illustrated in FIGS. 1 to 6, 6A, and 7 to 13, within a wellbore string disposed in a wellbore.

Referring to FIG. 14, there is provided a flow control apparatus 10 for selectively stimulating a reservoir 300 of a subterranean formation 400. The flow control apparatus is deployable within a wellbore 200. Suitable wellbores include vertical, horizontal, deviated or multi-lateral wells.

The reservoir is stimulated by supplying treatment material from the surface 500 to a subterranean formation which includes the reservoir 300.

In some embodiments, for example, the treatment material is a liquid including water. In some embodiments, for example, the liquid includes water and chemical additives. In other embodiments, for example, the treatment material is a slurry including water, proppant, and chemical additives.

Exemplary chemical additives include acids, sodium chloride, polyacrylamide, ethylene glycol, borate salts, sodium and potassium carbonates, glutaraldehyde, guar gum and other water soluble gels, citric acid, and isopropanol. In some embodiments, for example, the treatment material is supplied to effect hydraulic fracturing of the reservoir.

In some embodiments, for example, the treatment material includes water, and is supplied to effect waterflooding of the reservoir.

In some embodiments, for example, the treatment material includes water, and is supplied for transporting (or "flowing", or "pumping") a wellbore tool (such as, for example, a perforator) downhole by application of fluid pressure.

Figure 8:
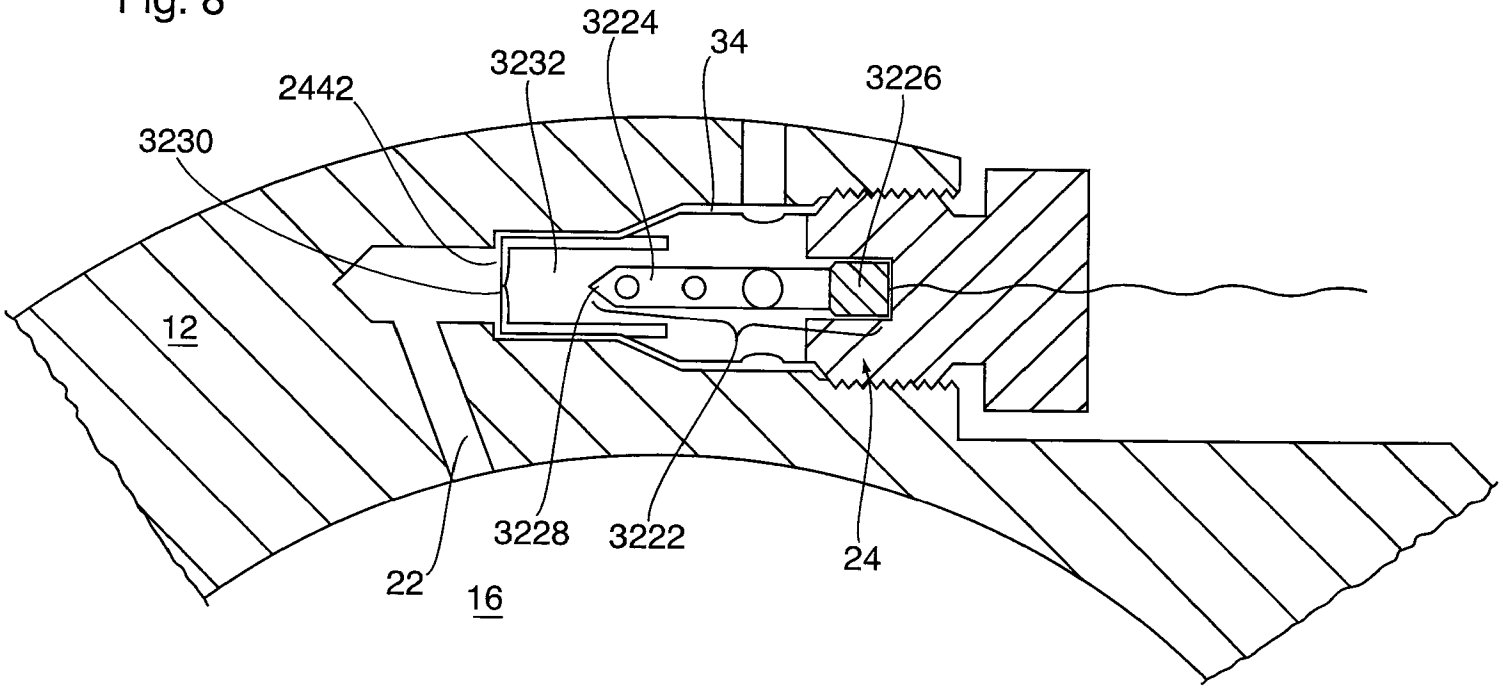
FIG. 8 is a sectional view of a fragment of another embodiment of the flow control apparatus having a cutter, illustrated prior to the puncturing of a rupture disc.

The flow control apparatus 10 may be deployed within the wellbore 200 and integrated within a wellbore string 100, such as, for example, a casing string (see FIG. 8).

Successive flow control apparatuses 10 may be spaced from each other such that each flow control apparatus is positioned adjacent a producing interval to be stimulated by fluid treatment effected by treatment material that may be supplied through a port 18 (see below).

Referring to FIGS. 1 to 6, 6A and 7, in some embodiments, for example, the flow control apparatus 10 includes a housing 12. In some embodiments, for example, the housing 12 includes interconnected top sub 12A, outer housing 12B, and bottom sub 12C.

The housing 12 is coupled (such as, for example, threaded) to the wellbore string 100. The wellbore string 100 is lining the wellbore 200. The wellbore string is provided for, amongst other things, supporting the subterranean formation within which the wellbore is disposed. The wellbore string may include multiple segments, and segments may be connected (such as by a threaded connection).

A housing passage 16 is defined within the housing 12. The housing passage 16 is configured for conducting treatment material from a supply source (such as at the surface) to a port 18 that is also defined within and extends through the housing 12.

The housing 12 includes a sealing surface configured for sealing engagement with a flow control member (see below). In some embodiments, for example, the sealing surface is defined by sealing members 11A, 11B. In some embodiments, for example, when a flow control member 14 is disposed in a position (the "closed position", see below) corresponding to the closed condition of the port 18, each one of the sealing members 11A, 11B, is, independently, disposed in sealing, or substantially sealing, engagement with both of the housing 12 and the flow control member 14. The sealing, or substantially sealing, engagement effects sealing, or substantial sealing, of fluid communication between the housing passage 16 and the port 18 (and thereby the wellbore, and, therefore, the subterranean formation 100).

In some embodiments, for example, each one of the sealing members 11A, 11B, independently, includes an o-ring. In some embodiments, for example, the o-ring is housed within a recess formed within the housing 12. In some embodiments, for example, each one of the sealing members 11A, 11B, independently, includes a molded sealing member (i.e. a sealing member that is fitted within, and/or bonded to, a groove formed within the sub that receives the sealing member).

The port 18 extends through the housing 12, and is disposed between the sealing surfaces 11*a*, 11*b*. In some embodiments, for example, the port 18 extends through the housing 12. During treatment, the port 18 effects fluid communication between the housing passage 16 and the wellbore. In this respect, during treatment, treatment material being conducted from the treatment material source via the housing passage 16 is supplied to the wellbore through the port.

In some embodiments, for example, it is desirable for the treatment material, being supplied to the wellbore through the port 18, be supplied, or at least substantially supplied, within a definite zone (or "interval") of the subterranean formation in the vicinity of the port. In this respect, the system may be configured to prevent, or at least interfere, with conduction of the treatment material, that is supplied to one zone of the subterranean formation, to a remote zone of the subterranean formation. In some embodiments, for example, such undesired conduction to a remote zone of the subterranean formation may be effected through an annulus, that is formed within the wellbore, between the casing and the subterranean formation. To prevent, or at least interfere, with conduction of the supplied treatment material to a zone of interval of the subterranean formation that is remote from the zone or interval of the subterranean formation to which it is intended that the treatment material is supplied, fluid communication, through the annulus, between the port and the remote zone, is prevented, or substantially prevented, or at least interfered with, by a zonal isolation material. In some embodiments, for example, the zonal isolation material includes cement, and, in such cases, during installation of the assembly within the wellbore, the casing string is cemented to the subterranean formation, and the resulting system is referred to as a cemented completion.

To at least mitigate ingress of cement during cementing, and also at least mitigate curing of cement in space that is in proximity to the port 18, or of any cement that has become disposed within the port, prior to cementing, the port may be filled with a viscous liquid material having a viscosity of at least 100 $mm^2/s$ at 40 degrees Celsius. Suitable viscous liquid materials include encapsulated cement retardant or grease. An exemplary grease is SKF LGHP 2TM grease. For illustrative purposes below, a cement retardant is described. However, it should be understood, other types of liquid viscous materials, as defined above, could be used in substitution for cement retardants.

In some embodiments, for example, the zonal isolation material includes a packer, and, in such cases, such completion is referred to as an open-hole completion.

In some embodiments, for example, the flow control apparatus 10 includes a flow control member 14, and the flow control member 14 is positionable, relative to the housing 12, in open and closed positions. The open position of the flow control member 14 corresponds to an open condition of the port 18.

In some embodiments, for example, the flow control member 14 includes a sleeve. The sleeve is slideably disposed within the housing passage 16.

While the flow control apparatus 10 is disposed within the wellbore, while the port 18 is disposed in a closed condition, the flow control member 14 is disposed in the closed position, and disposition of the flow control member 14 in the closed position is such that the port 18 is disposed in a closed condition. In some embodiments, for example, while the port 18 is closed, the flow control member 14 prevents, or substantially prevents, fluid flow through the port 18, between the housing passage 16 and the wellbore. In some embodiments, for example, while the port 18 is closed, the flow control member 14 is sealing, or substantially sealing, the port 18 such that a sealing interface is defined at the port 18.

The flow control member 14 may be displaced from the closed position to the open position and thereby effect opening of the port 18. In some embodiments, for example, such displacement is effected while the flow control apparatus is deployed downhole within a wellbore (such as, for example, as part of a wellbore string 200, such as a casing string), and such displacement, and consequential opening of the port 18, enables fluid, that is being supplied from the surface, for transporting a wellbore tool downhole through the wellbore, to be discharged through the port 18, such that fluid pressure within the casing string remains below excessive pressures that would otherwise interfere with subsequent downhole operations. In this respect, in some embodiments, for example, the apparatus 10 functions as a "toe valve" or "toe sleeve".

In some embodiments, for example, the flow control member 14 co-operates with the sealing members 11A, 11B to effect opening and closing of the port 18. In some embodiments, for example, when the port 18 is disposed in the closed condition, the flow control member is sealingly engaged to both of the sealing surfaces 11A, 11B, and preventing, or substantially preventing, fluid flow from the housing passage 16 to the port 18, and when the port 18 is disposed in the open condition, the flow control member 16 is spaced apart or retracted from at least one of the sealing members (such as the sealing surface 11A), thereby providing a housing passage 16 for treatment material to be delivered to the port 18 from the housing passage 16.

The flow control member 14 is configured for displacement, relative to the port 18, from the closed position (see FIGS. 1 and 3) to the open position (see FIG. 5) in response to application of a sufficient net opening force. In some embodiments, for example, the application of a sufficient net opening force is effected by a fluid pressure differential.

In some embodiments, for example, the housing 12 includes an inlet 28. When the port 18 is disposed in the open condition, fluid communication is effected between the inlet 28 and the port 18 via the housing passage 16. When the port 18 is disposed in the closed condition, sealing, or substantial sealing of fluid communication, between the inlet 28 and the port 18 is effected.

The flow control member 14 including a fluid responsive surface 20. In this respect, the fluid responsive surface 20 is said to be defined on the flow control member 14. The fluid responsive surface 20 is configured to receive a force applied by a communicated fluid to at least contribute to the establishment of the sufficient net opening force, which thereby effects the displacement of the flow control member 14.

A sensor 26 is coupled to the housing for sensing an actuating signal.

In some embodiments, for example, the sensor 26 is disposed in communication within the housing passage 16, and the actuating signal is being transmitted within the housing passage 16, such that the sensor 26 is disposed for sensing the actuating signal being transmitted within the housing passage 16. In some embodiments, for example, the sensor 26 is disposed within the housing passage 16. In this respect, in some embodiments, for example, the sensor is mounted to the housing 12 within a hole that is ported to the wellbore 200, and is held in by a backing plate that is configured to resist the force generated by pressure acting on the sensor 26.

Figure 15:
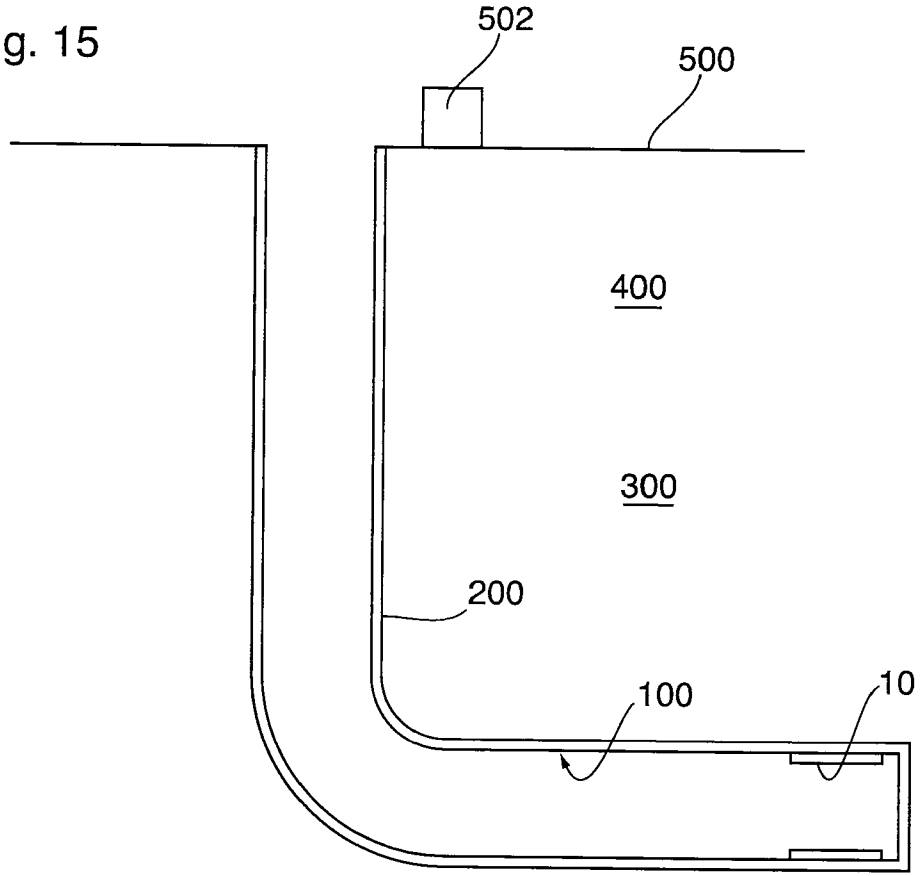
FIG. 15 is a schematic illustration of the incorporation of the flow control apparatus of any one of the embodiments illustrated in FIGS. 1 to 6, 6A, and 7 to 13, within a wellbore string disposed in a wellbore, and a seismic vibration unit for generating an actuating signal to be received by the sensor.

Referring to FIG. 15, in some embodiments, for example, the sensor 26 is configured to receive a signal generated by a seismic source. In some embodiments, for example, the seismic source includes a seismic vibrator unit 502. In some of these embodiments, for example, the seismic vibration unit 502 is disposed at the surface 500.

The sensor 26 is configured to effect the displacement of the valve 24 in response to sensing of a actuating signal being transmitted via fluid within the housing passage 16, such that the fluid communication between the housing passage 16 and the pressure responsive surface 20 is effected, and such that a force is thereby applied to the pressure responsive surface 20 so as to at least contribute to the sufficient net opening force that effects the displacement of the flow control member 14. In some embodiments, for example, the sensor 26 is a pressure sensor, and the actuating signal is one or more pressure pulses. An exemplary pressure sensor is a Kellar Pressure Transducer Model 6LHP/81188TM.

Other suitable sensors may be employed, depending on the nature of the signal being used for the actuating signal. Other suitable sensors include a Hall effect sensor, a radio frequency identification ("RFID") sensor, or a sensor that can detect a change in chemistry (such as, for example, pH), or radiation levels, or ultrasonic waves.

In some embodiments, for example, the actuating signal is defined by a pressure pulse characterized by at least a magnitude. In some embodiments, for example, the pressure pulse is further characterized by at least a duration. In some embodiments, for example, the actuating signal is defined by a pressure pulse characterized by at least a duration.

In some embodiments, for example, the actuating signal is defined by a plurality of pressure pulses. In some embodiments, for example, the actuating signal is defined by a plurality of pressure pulses, each one of the pressure pulses characterized by at least a magnitude. In some embodiments, for example, the actuating signal is defined by a plurality of pressure pulses, each one of the pressure pulses characterized by at least a magnitude and a duration. In some embodiments, for example, the actuating signal is defined by a plurality of pressure pulses, each one of the pressure pulses characterized by at least a duration. In some embodiments, for example, each one of pressure pulses is characterized by time intervals between the pulses.

In one aspect, there apparatus 10 includes a trigger 15. The trigger 15 is configured for effecting fluid communication between the housing passage 16 and the fluid responsive surface 20, in response to the sensing of an actuating signal by the sensor 26. The fluid communication is effected for effecting the displacement of the flow control member 14.

Referring to FIGS. 1 to 6, 6A, 7, 8 and 9, in some embodiments, for example, the trigger includes a valve 24 and a valve actuator 32. The valve actuator 32 is configured to effect a change in condition of the valve 24 such that fluid communication becomes effected between the housing passage 16 and the fluid responsive surface 20, in response to the sensing of an actuating signal by the sensor 26.

Referring to FIGS. 1 to 6, 6A and 7, in some embodiments, for example, the valve 24 is displaceable, and the change in condition of the valve 24, which the valve actuator 32 is configured to effect in response to the sensing of an actuating signal by the sensor 26, includes displacement of the valve 24. In this respect, The valve actuator 32 is configured to effect displacement of the valve 24 such that fluid communication becomes effected between the housing passage 16 and the fluid responsive surface 20 of the flow control member 14. The flow control apparatus 10 further includes a fluid communication passage 22. The fluid communication passage 22 is provided for effecting fluid communication between the housing passage 16 and the fluid responsive surface 20 so as to effect the displacement of the flow control member 14. The establishing of such fluid communication is controlled by the positioning of the valve 24 relative to the fluid communication passage 22. The valve 24 is configured for displacement relative to the fluid communication passage 22. In some embodiments, for example, the valve 24 includes a piston. The displacement of the valve 24 is from a closed position (see FIGS. 1 and 2) to an open position (see FIGS. 3 and 4). In some embodiments, for example, when disposed in the closed position, the valve 24 is occluding the fluid communication passage 22. In some embodiments, for example, when the valve 24 is disposed in the closed position, sealing, or substantial sealing, of fluid communication, between the housing passage 16 and the pressure responsive surface 20, is effected. When the valve 24 is disposed in the open position, fluid communication is effected between the housing passage 16 and the fluid responsive surface 20. In this respect, this enables application of a force to the fluid responsive surface 20 of the flow control member 14 by fluid communicated from the housing passage 16, and thereby effecting displacement of the flow control member 14.

In some embodiments, for example, to mitigate versus inadvertent opening, the valve 24 may, initially, be detachably secured to the housing 12, in the closed position. In this respect, in some embodiments, for example, the detachable securing is effected by a shear pin configured for becoming sheared, in response to application of sufficient shearing force, such that the valve 24 becomes movable from the closed position to the open position. In some embodiments, for example, the shearing force is effected by an valve actuator 32 (see below).

In some embodiments, for example, to prevent the inadvertent opening of the valve 24, the valve 24 may be biased to the closed position, such as by, for example, a resilient member such as a spring. In this respect, an valve actuator used for effecting opening of the valve 24 (see below) must exert sufficient force to at least overcome the biasing force being applied to the valve 24 that is maintaining the valve 24 in the closed position.

In some embodiments, for example, to prevent the inadvertent opening of the valve 24, the valve 24 may be pressure balanced such that the valve 24 is disposed in the closed position.

In some embodiments, for example, the fluid communication passage 22 is defined within (and extends through) the flow control member 14, and the valve 24 is disposed in a space defined between the flow control member 14 and the housing 12, such that the displacement of the valve 24 is also relative to the flow control member 14.

In some embodiments, for example, the valve actuator 32 includes an electro-mechanical trigger, such as a squib. The squib is configured to, in response to the signal received by the sensor 26, effect generation of an explosion. In some embodiments, for example, the squib is mounted within the housing 12 such that the generated explosion effects the displacement of the flow control member 14. Another suitable valve actuator 32 is a fuse-able link or a piston pusher.

Figure 9:
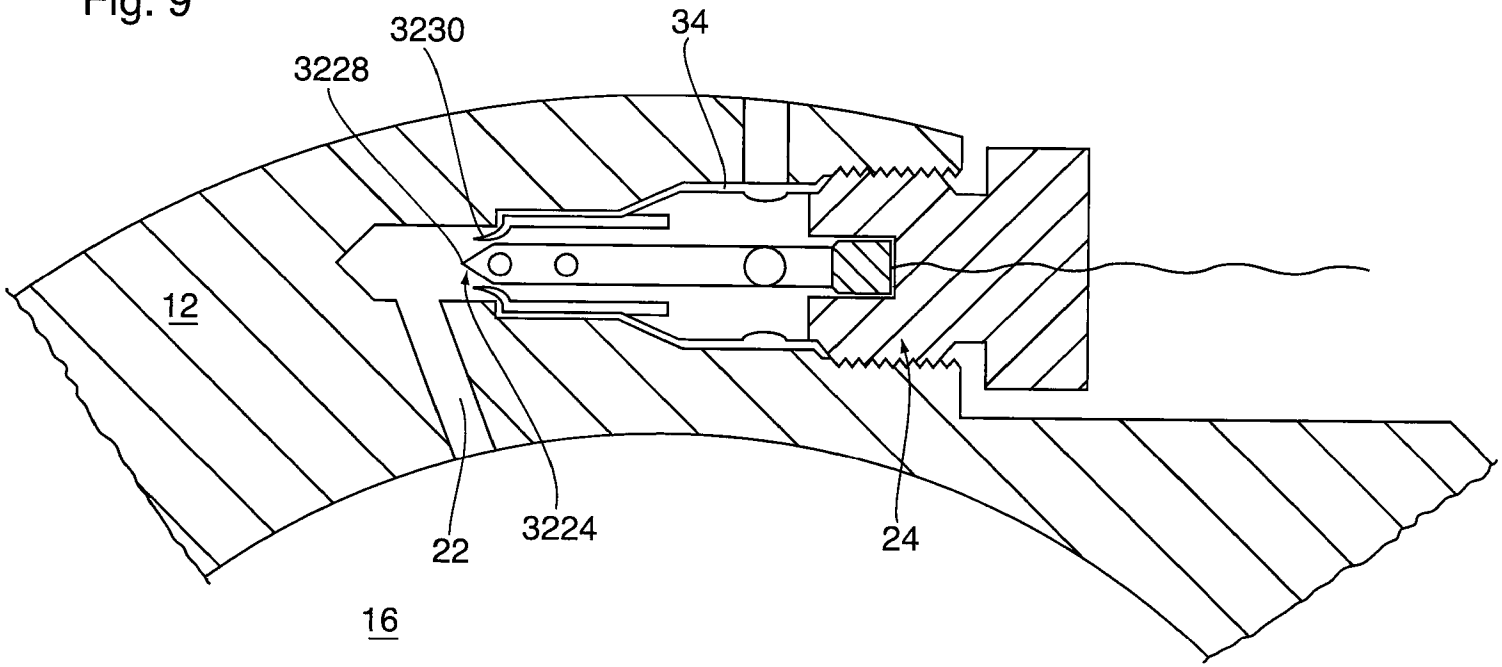
FIG. 9 is a sectional view of a fragment of another embodiment of the flow control apparatus shown in FIG. 8, illustrated after the puncturing of a rupture disc by the cutter.

Referring to FIGS. 8 and 9, in some embodiments, for example, the valve 24 includes a communication sealing surface 2442 for effecting the sealing, or substantial sealing, of fluid communication between the housing passage 16 and the fluid responsive surface 20. Also, the change in condition of the valve, which the valve actuator 3222 is configured to effect in response to the sensing of an actuating signal by the sensor 26, includes a change in condition of the communication sealing surface 2442 such that fluid communication becomes effected between the housing passage 16 and the fluid responsive surface 20. In some embodiments, for example, a fluid communication passage 22 is extending between the housing passage 16 and the fluid responsive surface 20, and the sealing, or substantial sealing, of fluid communication between the housing passage 16 and the fluid responsive surface 20, is effected by sealing, or substantial sealing, of the fluid communication passage by the communication sealing surface 3222. In some embodiments, for example, the valve actuator 3222 includes a cutter 3224 configured for puncturing the communication sealing surface 2442 such that the change in condition of the communication sealing surface 3222 is effected, and a cutter actuator 3226 for effecting displacement of the cutter 3224 such that the puncturing is effected, in response to the sensing of an actuating signal by the sensor 26. In some embodiments, for example, the cutter 3224 is threaded into the housing 12. In some embodiments, for example, the cutter actuator 3226 includes a squib and is suitably mounted for effecting displacement of the cutter 3224 such that the puncturing is effected. In some embodiments, for example, the cutter 3224 includes a bayonet 3228, and the communication sealing surface is defined on a sealing member, and, in some embodiments, for example, the sealing member is defined by a rupture disc 3230 and a ferrule seat. Upon actuation by the squib 226, the bayonet 3228 punctures the rupture disc 3220, such that fluid communication is effected between the passage 22 and the fluid responsive surface 20 via a passageway 3232 within the valve 24.

Figure 10:
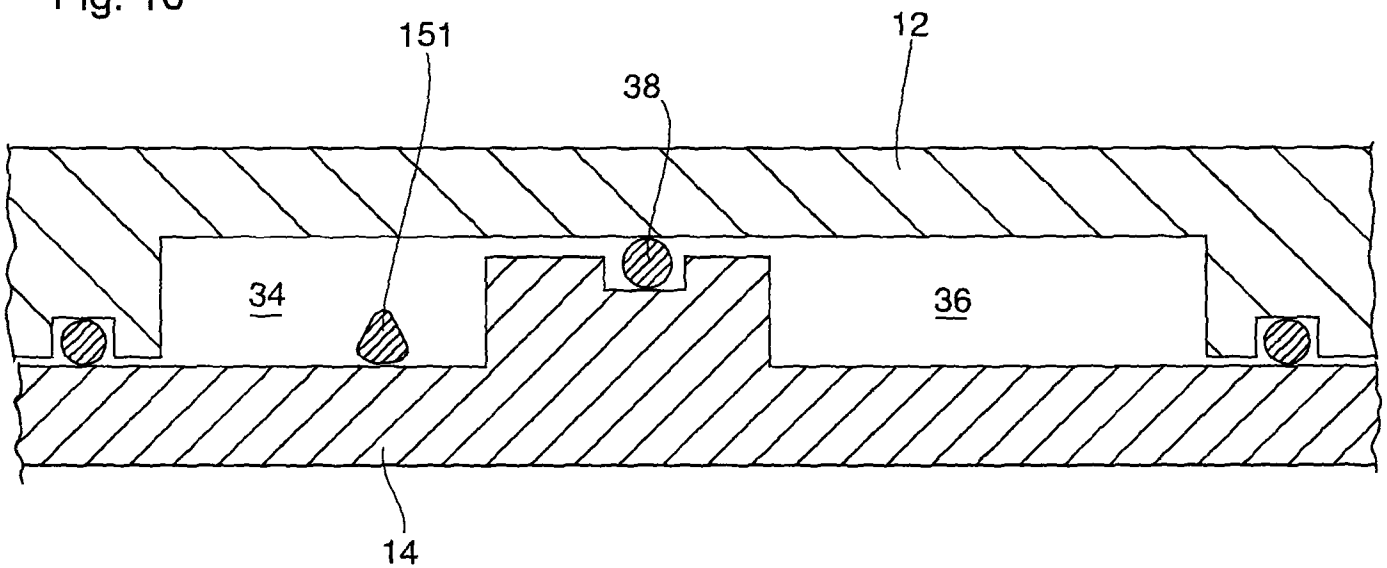
FIG. 10 is a sectional view of a fragment of another embodiment of the flow control apparatus having a shaped charge, illustrated prior to detonation of the shaped charge.
Figure 11:
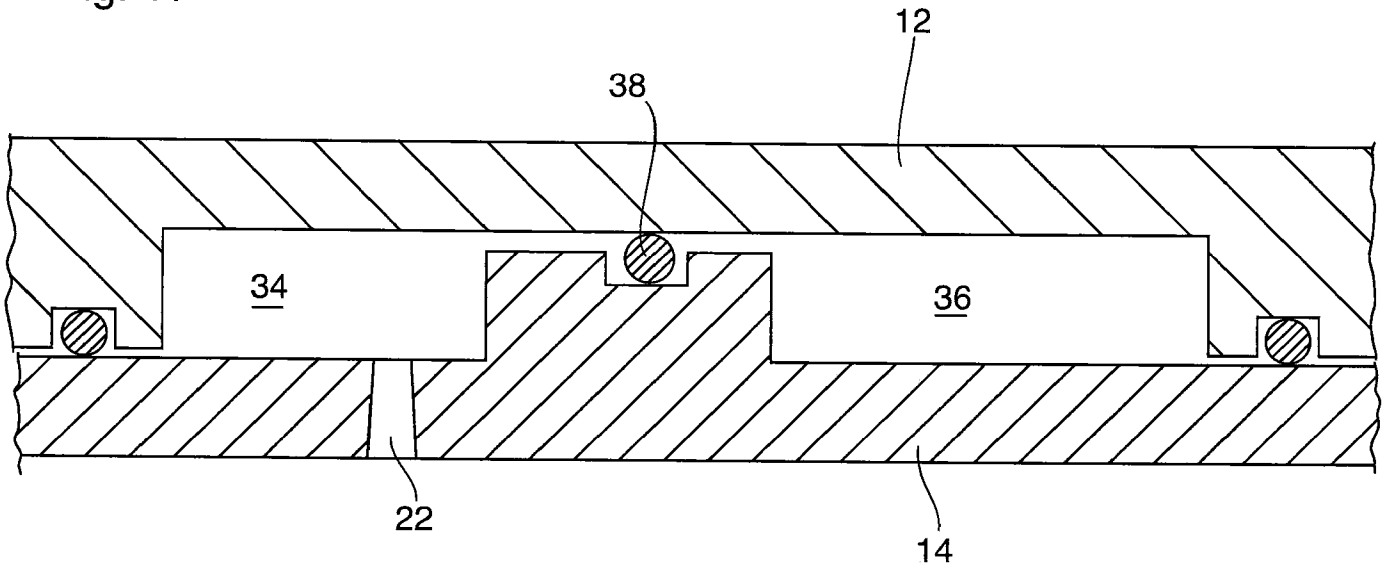
FIG. 11 is a sectional view of a fragment of the embodiment of the flow control apparatus shown in FIG. 10, illustrated after detonation of the shaped charge.

Referring to FIGS. 10 and 11, in some embodiments, for example, the trigger 15 includes a shaped charge 151 for effecting generation of an explosion, in response to the sensing of an actuating signal by the sensor 26, wherein the explosion is sufficient to effect creation of the fluid communication passage 22 that extends through the flow control member 14 and effects fluid communication between the housing passage 16 and the fluid responsive surface 20.

The shaped charge is mounted to the housing 12 and disposed between the flow control member 14 and the housing 12. The shaped charge is directed at the flow control member 14 such that, when detonated, the jet produced by the charge would cut a hole in the flow control member 14, such hole defining the fluid communication passage 22.

In some embodiments, for example, the flow control apparatus 10 further includes first and second chambers 34, 36, and the sufficient net opening force is effected when application of an opening force, to the flow control member 14, by fluid disposed within the first chamber 34, exceeds a closing force, applied to the flow control member 14, by fluid disposed within the second chamber 36. Each one of the first and second chambers 34, 36 are, at least in part, defined by one or more surface portions of the flow control member 14, such that fluid, within each one of the chambers 34, 36, is applying a force to the flow control member 14. The fluid within the first chamber 34 is applying an opening force to the flow control member 14 (in the illustrated embodiment, for example, in the downhole direction), and the fluid within the second chamber 36 is applying a closing force to the flow control member 14 (in the illustrated embodiment, in the uphole direction). When the opening force being applied to the flow control member 14 by fluid disposed within the first chamber 34 exceeds the closing force being applied to the flow control member 14 by fluid disposed within the second chamber 36, the displacement of the flow control member 14 to the open position (see FIG. 5) is effected.

When the application of an opening force, to the flow control member 14, by fluid disposed within the first chamber 34, exceeds the closing force, applied to the flow control member 14, by fluid disposed within the second chamber 36, the opening force applied by fluid disposed within the first chamber 34 includes that applied by fluid (that is disposed in fluid communication with the housing passage 16) to the fluid responsive surface 20. In this respect, the first fluid chamber 34 is disposed in fluid communication with the fluid responsive surface 20. As a necessary incident, this also means that, under these circumstances, the first fluid chamber 34 is disposed in fluid communication with the housing passage 16. This also means that the first fluid chamber 34 is disposable, to a state of fluid communication with the housing passage 16. In the embodiments illustrated in FIGS. 1 to 6, 6A, and 7, this is effectible by displacement of the valve 26, and in the embodiments illustrated in FIGS. 10 and 11, this is effectible by the creation of the fluid communication passage 22 by the shaped charge 151.

In some embodiments, for example, the sufficient net opening force is effected by a fluid pressure differential between the first chamber 34 and the second chamber 36 such that fluid pressure within the first chamber 34 exceeds fluid pressure within the second chamber 36. In some embodiments, for example, the exceeding of the fluid pressure within the second chamber 36 by the fluid pressure within the first chamber 34 is effected by the effecting of fluid communication between the first chamber 34 and the housing passage 16, upon the displacement of the valve 24 from the closed position to the open position. In some embodiments, for example, the second chamber 36 is disposed at, or substantially at, atmospheric pressure.

In summary, the sufficient net opening force, effecting the displacement of the flow control member 14, includes a force component that is (a) urging the displacement of the flow control member 14 to the open position, and (b) is being applied to the fluid responsive surface 20 by fluid (such as, for example, fluid within the first chamber 34) that has been communicated from the housing passage 16 in response to, in some embodiments (see FIGS. 1 to 6, 6A, and 7), the displacement of the valve 24, and in other embodiments, (see FIGS. 10 and 11), the creation of the fluid communication passage 22 by the shaped charge 151.

In some embodiments, for example, both of the first and second chambers 34, 36 are defined by respective spaces interposed between the housing 12 and the flow control member 14, and a chamber sealing member 38 is also included for effecting a sealing interface between the chambers 34, 36, while the flow control member 14 is being displaced to effect the opening of the port 18. The chamber sealing member 38, the housing 12, and the flow control member 14 are co-operatively configured such that: (i) while the flow control member is disposed in the closed position, the chamber sealing member 38 is sealing engaged to both of the housing 12 and the flow control member 14 such that the sealing, or substantial sealing, of fluid communication between the first and second chambers 34, 36 is effected; and (ii) in response to displacement of the flow control member 14 to the open position, the chamber sealing member 38 changes its disposition, relative to the housing 12 and the flow control member 14, such that the flow control member 14 is displaced such that there is a loss of the sealing engagement, resulting in a condition where there is an absence of sealing, or substantial sealing, engagement between the chamber sealing member 38 and at least one of the housing 12 and the flow control member 14 such that the first chamber 34 is disposed in fluid communication with the second chamber 36. In doing so, the pressures within the first and second chambers 34, 36 become balanced. Concomitantly, the fluid pressure differential existing between the first and second chambers 34, 36 is now rendered non-existent or substantially non-existent, thereby removing interference in those embodiments where it is desirable to return the flow control member 14 to the closed position, and thereby close the port 18.

In some embodiments, for example, one of the housing 12 and the flow control member 14 (in the illustrated embodiment, this would be the housing 12) includes a recess 40 that represents a sufficient increase in spacing between the housing 12 and the flow control member 14, as the flow control member 14 is being displaced relative to the housing 12 to the open position, such that the loss in sealing engagement of the displaceable chamber sealing member 38 with at least one of the housing 12 and the flow control member 14 is effected while the displaceable chamber sealing member 38 is disposed within the recess 40. The disposition of the displaceable chamber sealing member 38 within the recess 40 is effected when the flow control member 40 is disposed in the open position.

In some embodiments, for example, the chamber sealing member 38 is carried by the flow control member 14 and the housing 12 includes the recess 40. Alternatively, the flow control member 14 can include the recess, and the housing 12 can contain the chamber sealing member 38. In this respect, one of the housing 12 and the flow control member 14 includes a recess 40, and the housing 12, the flow control member 14, and the chamber sealing member 38 are co-operatively configured such that, in response to the displacement of the flow control member 14 to the open position, the chamber sealing member 38 is displaced and becomes disposed within the recess 40 such that there is a loss of the sealing engagement, such that the absence of sealing, or substantial sealing, engagement between the chamber sealing member 38 and at least one of the housing 12 and the flow control member 14 is effected.

Figure 1:
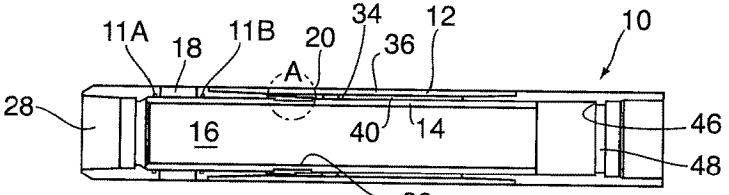
FIG. 1 is a sectional view of an embodiment of the flow control apparatus, showing the port disposed in the closed condition, and with both of the flow control valve member and the pressure control valve member disposed in the closed positions.
Figure 3:
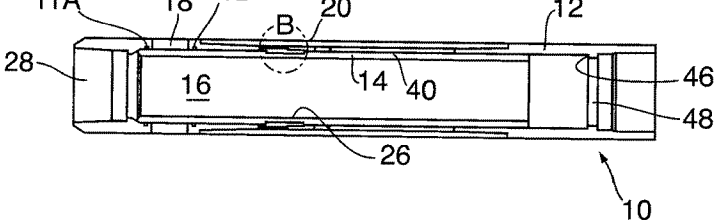
FIG. 3 is a sectional view of an embodiment of the flow control apparatus illustrated in FIG. 1, showing the port disposed in the closed condition, and with the pressure control valve member disposed in the open position, and with the flow control valve member disposed in the closed position.
Figure 4:
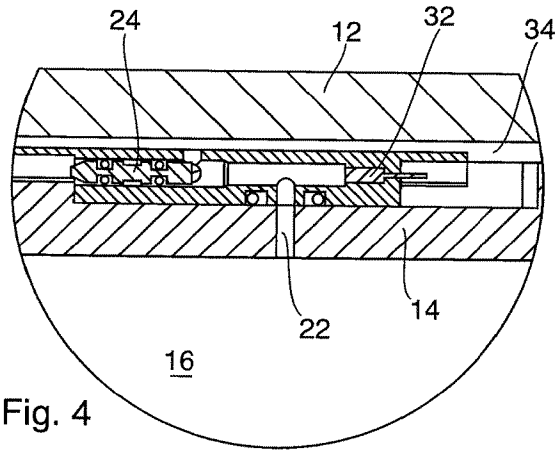
FIG. 4 is a detailed view of Detail "B" in FIG. 3.
Figure 2:
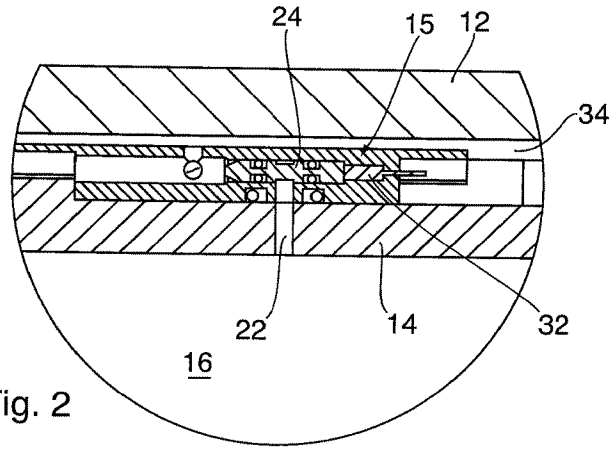
FIG. 2 is a detailed view of Detail "A" in FIG. 1.
Figure 6:
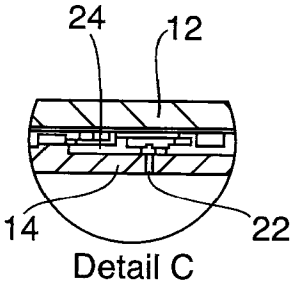
FIG. 6 is a detailed view of Detail "C" in FIG. 5.
Figure 5:
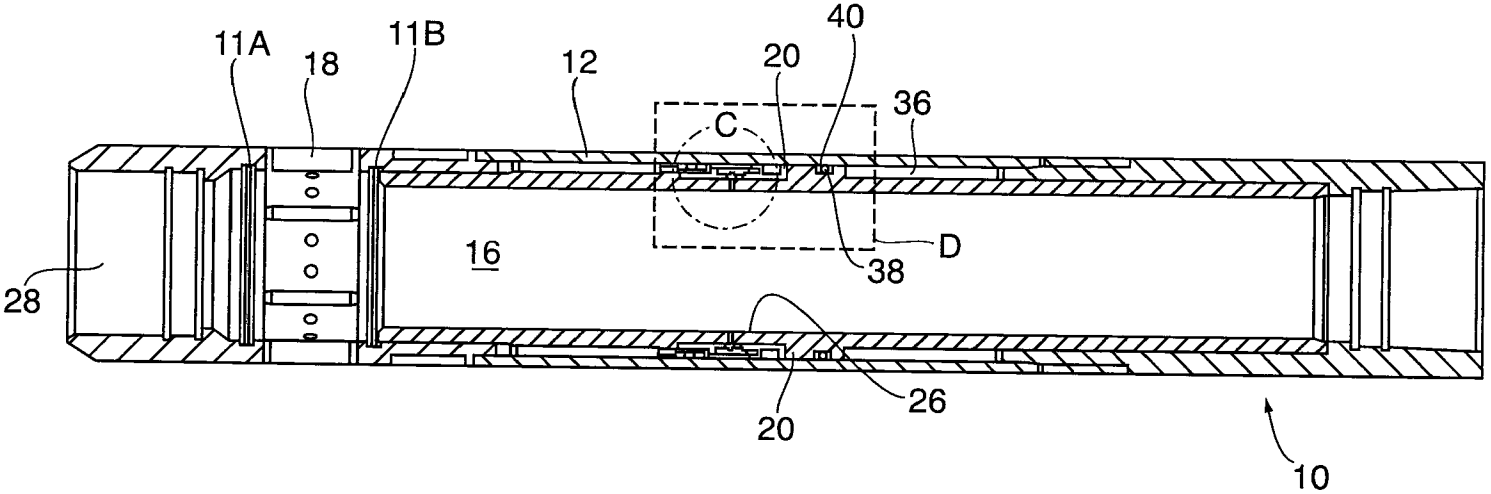
FIG. 5 is a sectional view of an embodiment of the flow control apparatus illustrated in FIG. 1, showing the port disposed in the open condition, and with both of the flow control valve member and the pressure control valve member disposed in the open positions.
Figure 6A:
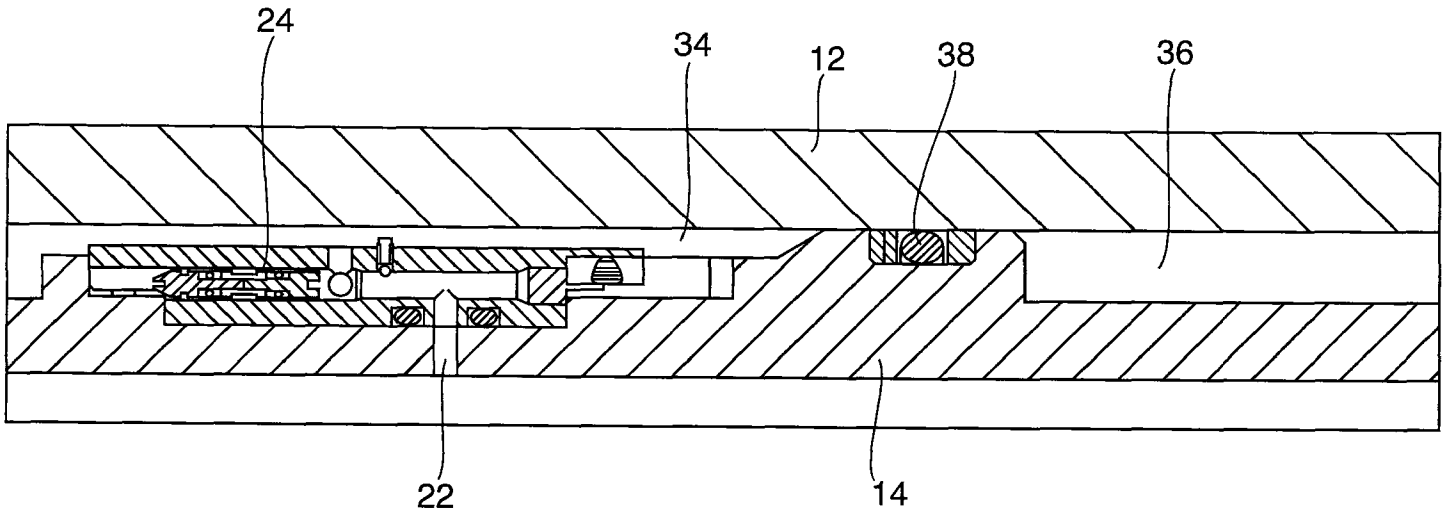
FIG. 6A is a detailed view of Detail "D" in FIG. 5.
Figure 7:
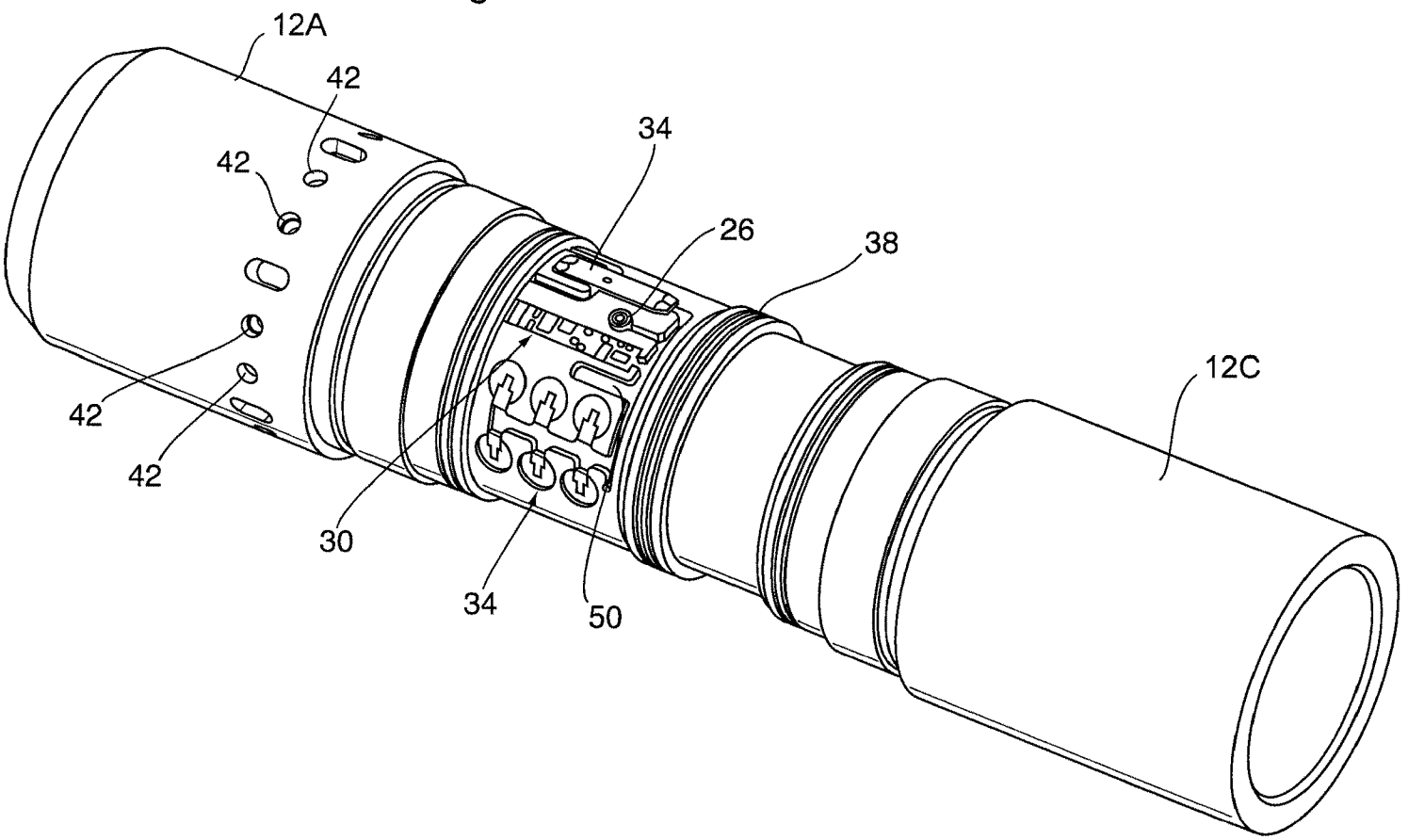
FIG. 7 is a perspective view of the flow control apparatus illustrated in FIG. 1, with the outer housing and wiring removed for clarity.

Referring to FIG. 7, in some embodiments, for example, the flow control apparatus 10 further includes a controller 30. The controller 30 is configured to receive a sensor-transmitted signal from the sensor 26 upon the sensing of the actuating signal and, in response to the received sensor-transmitted signal, supply a transmitted signal to the trigger 15 to effect the displacement of the flow control member 14. In some embodiments, for example, the controller 30 and the sensor 26 are powered by a battery 34 that is also housed within the flow control member 14. Passages 50 for wiring for electrically interconnecting the battery 34, the sensor 26, the controller 30 and the trigger 15 (and in those embodiments where the trigger 15 includes the valve 24 and the valve actuator, the valve actuator 32) is also illustrated (wiring is not shown).

Figure 12:
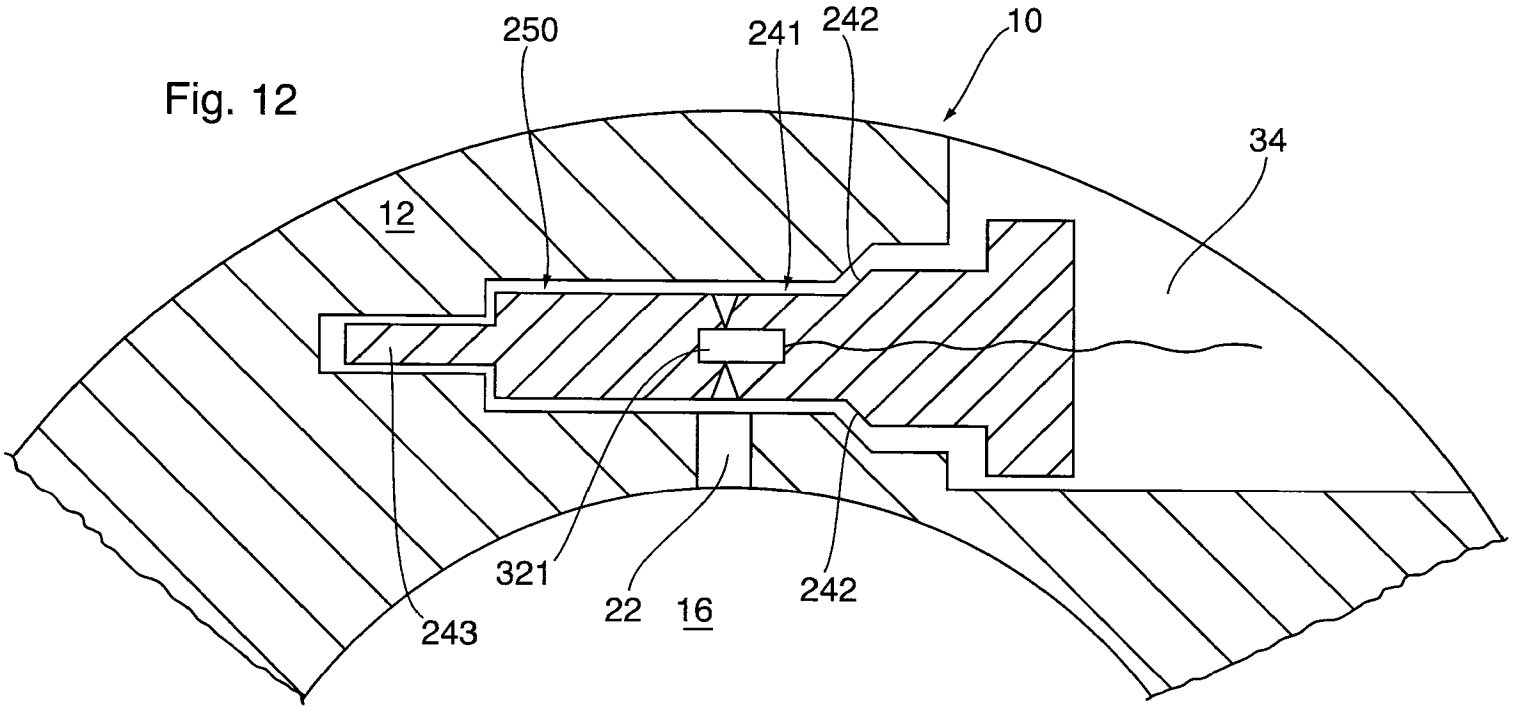
FIG. 12 is sectional view of a fragment of another embodiment of the flow control apparatus having an exploding bolt, illustrated prior to fracturing of the bolt.
Figure 13:
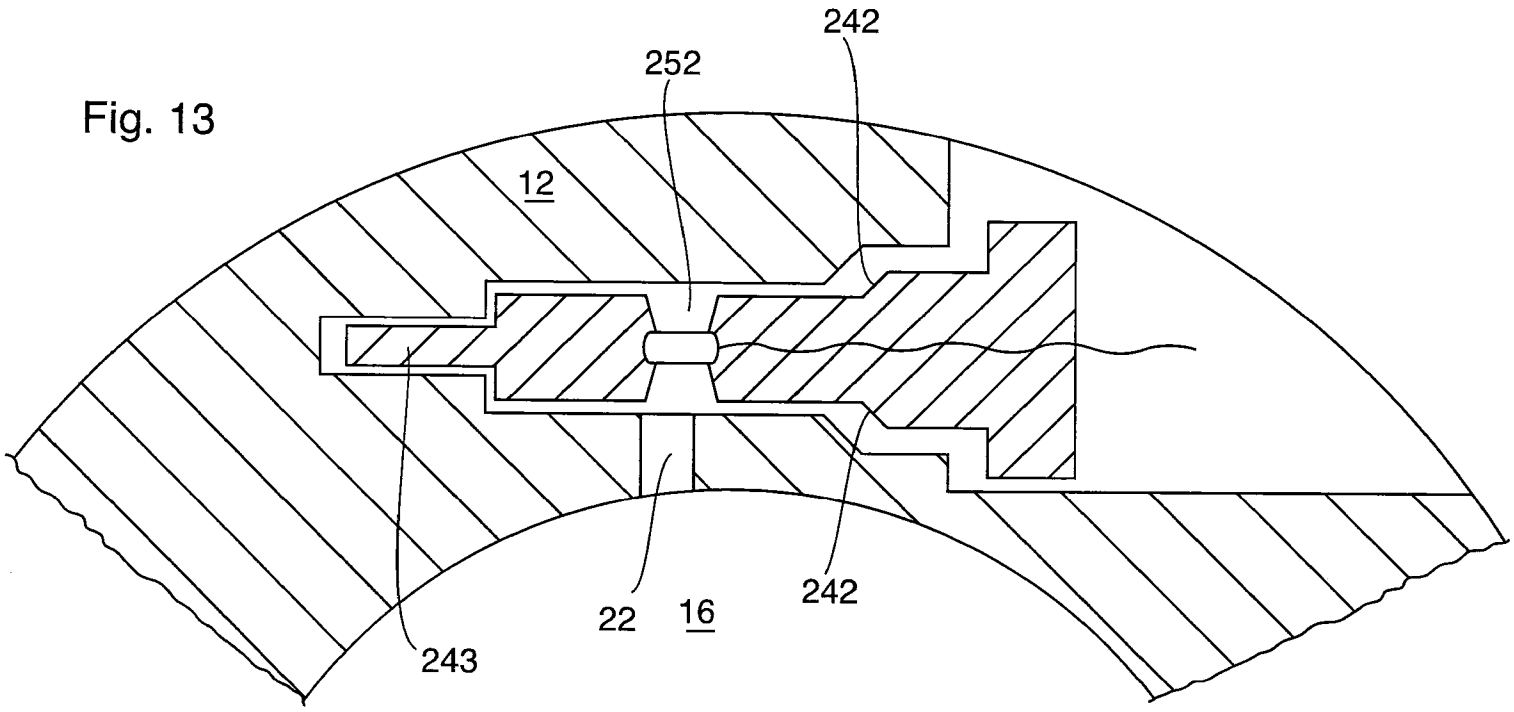
FIG. 13 is sectional view of a fragment of the embodiment of the flow control apparatus shown in FIG. 12, illustrated after fracturing of the bolt.

Referring to FIGS. 12 and 13, in another aspect, the flow control apparatus 10 includes a valve 241 and an valve actuator 321. The valve 241 includes a communication sealing surface 242 for effecting sealing, or substantial sealing, of fluid communication between the housing passage 16 and the fluid responsive surface 20. The valve actuator 321 is responsive to sensing of the actuating signal by the sensor 26, for effecting a change in condition of the valve 241 such that the communication sealing surface 242 becomes displaceable relative to the housing 12 such that a loss of the sealing, or substantial sealing, of the fluid communication between the housing passage 16 and the fluid responsive surface 20 is effectible, with effect that an absence of sealing, or substantial sealing, of the fluid communication between the housing passage 16 and the fluid responsive surface 20 is effectible, such that fluid communication between the housing passage 16 and the fluid responsive surface 20 is effectible. The change in condition of the valve 241 is from a sealing condition to a fluid communication-effectible condition.

In some embodiments, for example, the housing passage 16, valve 241, and pressure responsive surface 20 are co-operatively configured such that, while the communication sealing surface 242 is displaceable relative to the housing 12, displacement of the communication sealing surface 242, for effecting the fluid communication between the housing passage 16 and the fluid responsive surface 20, is effectible in response to urging of the communication sealing surface 242 by fluid disposed within the housing passage 16. In this respect, while the communication sealing surface 242 is displaceable relative to the housing 12, fluid, disposed within the housing passage 16. functions to urge displacement of the communication sealing surface 242, relative to the housing 12, such that fluid communication between the housing passage 16 and the fluid responsive surface 20, is effected.

In some embodiments, for example, the valve 241 includes a coupler 243 that interacts with the housing 12 such that, while the valve 241 is in the sealing condition, the valve 241 is coupled to the housing 12 such that the communication sealing surface 242 is effecting sealing, or substantially sealing, of fluid communication between the housing passage 16 and the fluid responsive surface 20. In some embodiments, for example, the coupler 243 is threaded to the housing 12.

In some embodiments, for example, the change in condition of the valve 241 includes at least a weakening of at least a portion of the valve 241. In some embodiments, for example, the valve 241 and the housing passage 16 are co-operatively configured such that, while the at least a portion of the valve 241 is weakened, the valve 241 is conditioned for fracturing (such as, for example, at the weakened portion) in response to a force being applied by a fluid, disposed within the housing passage 16, to the weakened portion of the valve 241. In some embodiments, for example, the conditioning of the valve 241 for fracturing is such that, upon fracturing, the displacement of the communication sealing surface 242 is effected such that fluid communication becomes effected between the housing passage 16 and the fluid responsive surface 20. In some embodiments, for example, the valve 241 and the housing passage 16 are co-operatively disposed such that, in response to the fracturing of the valve 241, the communication sealing surface 242 becomes displaceable such that, in response to a force applied by fluid disposed within the housing passage 16, the communication sealing surface 242 is displaced such that fluid communication becomes effected between the housing passage 16 and the fluid responsive surface 20.

In some embodiments, for example, the change in condition of the valve 241 includes a fracturing of the valve 241. In the embodiment illustrated in FIGS. 10 and 11, the fracture is identified by reference numeral 252. In some embodiments, for example, the fracturing is such that fluid communication becomes effected between the housing passage 16 and the fluid responsive surface 20. In some embodiments, for example, the valve 241 and the housing passage 16 are co-operatively disposed such that, in response to the fracturing of the valve 241, the communication sealing surface 242 becomes displaceable such that, in response to a force applied by fluid disposed within the housing passage 16, the communication sealing surface 242 is displaced such that fluid communication becomes effected between the housing passage 16 and the fluid responsive surface 20.

In some embodiments, for example, the fluid communication passage 22 extends between the housing passage 16 and the fluid responsive surface 20, and the sealing, or substantial sealing, of fluid communication between the housing passage 16 and the fluid responsive surface 20, is effected by sealing, or substantial sealing, of the fluid communication passage 22 by the communication sealing surface 242. In some of these embodiments, for example, the fluid communication passage 22 extends through the flow control member 14, and the valve 241 is disposed between the flow control member 14 and the housing 12.

In some embodiments, for example, the valve actuator 341 includes a squib, and the change in condition is effected by an explosion generated by the squib in response to sensing of the actuating signal by the sensor 26. In some embodiments, for example, the squib is suitably mounted to apply the necessary force to the valve 241.

In some embodiments, for example, the valve 241 and the valve actuator 341 are defined by an exploding bolt 250, such that the flow control apparatus 14 includes the exploding bolt 250. In some embodiments, for example, the squib is integrated into the bolt 250.

Similar to the embodiment illustrated in FIGS. 1 to 6, 6A and 7, and the embodiment illustrated in FIGS. 8 and 9, and the embodiment illustrated in FIGS. 10 and 11, the embodiment of the flow control apparatus 10 illustrated in FIGS. 12 and 13 includes first and second chambers 34, 36 (second chamber 36 is not shown for this embodiment) disposed within the housing 12. In the case of the embodiment of the flow control apparatus 10 illustrated in FIGS. 10 and 11, however, the first chamber 34 is disposable into fluid communication with the housing passage 16 in response to a displacement of the communication sealing surface 242.

In some embodiments, the housing 12 further includes a constricting portion 46 that defines a constricted portion 48 of the housing passage 16 for interfering with movement of the flow control member 14. In some embodiments, for example, the flow control member 14 is configured to deform and become pinched by the constricting portion 46 while moving through the constricted portion 48 of the housing passage 16. The pinching is such that interference is provided to the displacement of the flow control member 14 to the closed position.

In some embodiments, for example, while the flow control apparatus 10 is being deployed downhole, the flow control member 14 is maintained in a position, by one or more shear pins 42 (see FIG. 6), such that the port 18 remain disposed in the closed condition. The one or more shear pins 42 are provided to secure the flow control member to the casing string so that the housing passage 16 is maintained fluidically isolated from the reservoir until it is desired to treat the reservoir with treatment material. To effect the initial change in disposition of the flow control member 14 from the first position to the second position, sufficient force must be applied to the one or more shear pins 42 such that the one or more shear pins become sheared, resulting in the flow control member becoming displaceable relative to the port. In some operational implementations, the force that effects the shearing is applied by fluid pressure being applied within the casing string.

An exemplary process for supplying fluid to a subterranean formation, through a wellbore string, disposed within a wellbore, and incorporating an embodiment of the flow control apparatus 10 illustrated in FIGS. 1 to 6, 6A, and 7, will now be described. Initially, the flow control member 14 is disposed in the closed position, the first and second chambers 34, 36 are disposed at atmospheric pressure, and the valve 24 is disposed in the closed position (see FIGS. 1 and 2). The shear pins 42 are interfering with inadvertent opening of the flow control member 14. The actuating signal (such as one or more pressure pulses) is transmitted downhole. The actuating signal is detected by the sensor 26. In response to the detection of the actuating signal, the sensor 26 transmits the sensor-transmitted signal to the controller 30. The controller 30 receives and processes the sensor-transmitted signal, and transmits an valve actuator signal to the valve actuator 32 (such as a suib). In response to receiving the actuation signal, the valve actuator 32 effects opening of the valve 24 (see FIGS. 3 and 4). After the valve 24 has become opened, fluid communication is effected between the first chamber 34 and the housing passage 16 via the fluid communication passage 22. Pressurized fluid, within the housing passage 16 (the pressurized fluid may or may not have already been disposed within the housing passage 16 while the actuating signal was being transmitted), is conducted to the first chamber 34, via the fluid communication passage 22, to effect pressurization of the first chamber 34. When the opening force (being applied by fluid within the first chamber 34) acting on the flow control member 14 sufficiently exceeds the closing force (being applied by fluid within the second chamber 34) acting on the flow control member 14, the shear pins become sheared and the flow control member 14 is urged to move downhole, thereby effecting opening of the port 18 (see FIGS. 5 and 6). The displacement of the flow control member 14 is such that, after the port 18 has become disposed in the open condition, the displaceable chamber sealing member 38, being carried by the flow control member 14, becomes disposed within the recess. The fluid pressure differential, between the first and second chambers 34, 36, is sufficient to effect displacement of the sealing member 38 such that the sealing member 38 loses sealing, or substantially, sealing engagement with one or both of the housing 12 and the flow control member 14. In doing so, pressure equalization is effected between the first and second chambers 34, 36.

In the above description, for purposes of explanation, numerous details are set forth in order to provide a thorough understanding of the present disclosure. However, it will be apparent to one skilled in the art that these specific details are not required in order to practice the present disclosure. Although certain dimensions and materials are described for implementing the disclosed example embodiments, other suitable dimensions and/or materials may be used within the scope of this disclosure. All such modifications and variations, including all suitable current and future changes in technology, are believed to be within the sphere and scope of the present disclosure. All references mentioned are hereby incorporated by reference in their entirety.

The invention claimed is:

1. A flow control apparatus comprising:
a housing including a housing passage;
a port extending through the housing;
a flow control member including a fluid responsive surface, and configured for displacement, relative to the port, such that fluid communication is established between the port and the housing passage;
a sensor for sensing an actuating signal; and
a trigger configured for establishing fluid communication between the housing passage and the fluid responsive surface, in response to the sensing of an actuating signal by the sensor, for effecting displacement of the flow control member;
wherein the trigger comprises:
a valve; and
a valve actuator, wherein the valve actuator includes a squib configured to effect generation of an explosion, in response to the sensing of an actuating signal by the sensor, with effect that a change in condition of the valve is effected, such that the fluid communication between the housing passage and the fluid responsive surface becomes established.

2. The flow control apparatus as claimed in claim 1;
wherein:
the valve is displaceable relative to the housing; and
the change in condition of the valve, which the squib is configured to effect in response to the sensing of an actuating signal by the sensor, includes displacement of the valve relative to the housing.

3. The flow control apparatus as claimed in claim 2, further comprising:
a fluid communication passage extending between the housing passage and the fluid responsive surface;
wherein:
the effected displacement of the valve is from a closed position to an open position;
in the closed position, the valve is occluding the fluid communication passage; and
in the open position, the fluid communication between the housing passage and the fluid responsive surface is established.

4. The flow control apparatus as claimed in claim 3;
wherein:
the fluid communication passage extends through the flow control member; and
the valve is disposed between the flow control member and the housing.

5. The flow control apparatus as claimed in claim 2, further comprising:
a fluid communication passage extending between the housing passage and the fluid responsive surface;
wherein:
the effected displacement of the valve is from a closed position to an open position;
in the closed position, the valve is sealing, or substantially sealing, the fluid communication passage; and
in the open position, the fluid communication between the housing passage and the fluid responsive surface is established.

6. The flow control apparatus as claimed in claim 2;
wherein the valve includes a piston;
and further comprising:
a piston-conducting passage, disposed between the flow control member and the housing, for receiving the displacement of the piston.

7. The flow control apparatus as claimed in claim 1;
wherein:
the valve includes a communication sealing surface for effecting sealing, or substantial sealing, of fluid communication between the housing passage and the fluid responsive surface; and
the change in condition of the valve, which the squib is configured to effect in response to the sensing of an actuating signal by the sensor, includes a change in condition of the communication sealing surface such that the fluid communication between the housing passage and the fluid responsive surface becomes established.

8. The flow control apparatus as claimed in claim 7; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the communication sealing surface with effect that the fluid communication between the housing passage and the fluid responsive surface becomes established.

9. The flow control apparatus as claimed in claim 8; wherein the cutter includes a bayonet.

10. The flow control apparatus as claimed in claim 7, further comprising:

a fluid communication passage extending between the housing passage and the fluid responsive surface, wherein the sealing, or substantial sealing, of fluid communication between the housing passage and the fluid responsive surface, is effected by sealing, or substantial sealing, of the fluid communication passage by the communication sealing surface.

11. The flow control apparatus as claimed in claim 10; wherein the extending of the fluid communication passage, between the housing passage and the fluid responsive surface, includes extension through the flow control member.

12. The flow control apparatus as claimed in claim 11; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the communication sealing surface with effect that the fluid communication between the housing passage and the fluid responsive surface becomes established.

13. The flow control apparatus as claimed in claim 12; wherein the cutter includes a bayonet.

14. The flow control apparatus as claimed in claim 10; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the communication sealing surface with effect that the fluid communication between the housing passage and the fluid responsive surface becomes effected.

15. The flow control apparatus as claimed in claim 14; wherein the cutter includes a bayonet.

16. The flow control apparatus as claimed in claim 7; wherein the housing passage, and the flow control member are co-operatively configured such that, while pressurized fluid is disposed within the housing passage, and the fluid communication between the housing passage and the flow control member is established, the displacement of the flow control member is urged by the pressurized fluid.

17. The flow control apparatus as claimed in claim 16, further comprising:

a fluid communication passage extending between the housing passage and the fluid responsive surface, wherein the sealing, or substantial sealing, of fluid communication between the housing passage and the fluid responsive surface, is effected by sealing, or substantial sealing, of the fluid communication passage by the communication sealing surface.

18. The flow control apparatus as claimed in claim 17; wherein the cutter includes a bayonet.

19. The flow control apparatus as claimed in claim 17; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the communication sealing surface with effect that the fluid communication between the housing passage and the fluid responsive surface becomes effected.

20. The flow control apparatus as claimed in claim 19; wherein the cutter includes a bayonet.

21. The flow control apparatus as claimed in claim 16; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the communication sealing surface with effect that the fluid communication between the housing passage and the fluid responsive surface becomes effected.

22. The flow control apparatus as claimed in claim 1; wherein the housing passage, and the flow control member are co-operatively configured such that, while pressurized fluid is disposed within the housing passage, and the fluid communication between the housing passage and the flow control member is established, the displacement of the flow control member is urged by the pressurized fluid.

23. The flow control apparatus as claimed in claim 1; wherein the valve is biased for effecting sealing, or substantial sealing, of fluid communication between the housing passage and the fluid responsive surface.

24. The flow control apparatus as claimed in claim 23, further comprising:

a resilient member;

wherein the biasing is effected by the resilient member.

25. The flow control apparatus as claimed in claim 1; wherein:

the housing and the valve are co-operatively configured such that a sealed interface is defined; and the change in condition of the valve, which is effected by the generated explosion, includes a defeating of the sealed interface with effect that the fluid communication between the housing passage and the fluid responsive surface becomes established.

26. The flow control apparatus as claimed in claim 25; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the sealed interface with effect that the fluid communication between the housing passage and the fluid responsive surface becomes established.

27. The flow control apparatus as claimed in claim 26; wherein the cutter includes a bayonet.

28. The flow control apparatus as claimed in claim 25; wherein the housing passage, and the flow control member are co-operatively configured such that, while pressurized fluid is disposed within the housing passage, and the fluid communication between the housing passage and the flow control member is established, the displacement of the flow control member is urged by the pressurized fluid.

29. The flow control apparatus as claimed in claim 28, further comprising:

a fluid communication passage extending between the housing passage and the fluid responsive surface, wherein the sealed interface is disposed within the fluid communication passage such that fluid communication, between the housing passage and the fluid responsive surface, is sealed or substantially sealed.

30. The flow control apparatus as claimed in claim 29; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the sealed interface with effect that the fluid communication between the housing passage and the fluid responsive surface becomes established.

31. The flow control apparatus as claimed in claim 30; wherein:

the cutter includes a bayonet.

32. The flow control apparatus as claimed in claim 25, further comprising:

a fluid communication passage extending between the housing passage and the fluid responsive surface, wherein the sealed interface is disposed within the fluid communication passage such that fluid communication, between the housing passage and the fluid responsive surface, is sealed or substantially sealed.

33. The flow control apparatus as claimed in claim 32; wherein:

the valve actuator further includes a cutter; and the squib and the cutter are co-operatively configured such that, in response to the sensing of an actuating signal by the sensor, the squib generates an explosion and, in response to the generated explosion, the cutter is urged to puncture the sealed interface with effect that the fluid communication between the housing passage and the fluid responsive surface becomes effected.

34. The flow control apparatus as claimed in claim 33; wherein the cutter includes a bayonet.

35. A flow control apparatus comprising:

a housing including a housing passage;

a port extending through the housing;

a flow control member including a fluid responsive surface, and configured for displacement, relative to the port, such that fluid communication is established between the port and the housing passage;

a sensor for sensing an actuating signal;

a trigger configured for establishing fluid communication between the housing passage and the fluid responsive surface, in response to the sensing of an actuating signal by the sensor, for effecting displacement of the flow control member;

a first chamber;

a second chamber;

wherein:

each one of the first and second chambers, independently, is disposed in fluid communication with the flow control member;

the first and second chambers are co-operatively configured such that the displacement of the flow control member is effectible in response to application of an opening force, to the flow control member, by fluid disposed within the first chamber, that exceeds a closing force, applied to the flow control member, by fluid disposed within the second chamber; and the first chamber is disposable into fluid communication with the housing passage in response to the sensing of the actuating signal by the sensor, such that the fluid communication between the housing passage and the first chamber is establishable by the trigger;

wherein both of the first and second chambers are defined by respective spaces interposed between the housing and the flow control member;

and a chamber sealing member, wherein the chamber sealing member, the housing, and the flow control member are co-operatively configured such that:

(i) while the flow control member is disposed in a closed position such that the port is closed, the chamber sealing member is sealingly engaged to both of the housing and the flow control member such that the sealing, or substantial sealing, of fluid communication between the first and second chambers is effected; and (ii) in response to displacement of the flow control member such that fluid communication is effected between the port and the housing passage, the chamber sealing member changes its disposition, relative to the housing and the flow control member, such that there is an absence of sealing, or substantial sealing, engagement between the chamber sealing member and at least one of the housing and the flow control member such that the first chamber is disposed in fluid communication with the second chamber.

36. The flow control apparatus as claimed in claim 35; wherein:

one of the housing and the flow control member includes a recess;

the housing, the flow control member, and the chamber sealing member are co-operatively configured such that, in response to the displacement of the flow control member such that fluid communication is effected between the port and the housing passage, the chamber sealing member is displaced and becomes disposed within the recess such that the absence of sealing, or substantial sealing, engagement between the chamber sealing member and at least one of the housing and the flow control member is effected.

37. The flow control apparatus as claimed in claim 36; wherein the chamber sealing member is carried by the flow control member and the housing includes the recess.

38. A flow control apparatus comprising:

a housing including a housing passage;

a port extending through the housing;

a flow control member including a fluid responsive surface, and configured for displacement, relative to the port, such that fluid communication is established between the port and the housing passage;

a sensor for sensing an actuating signal;

a valve including a communication sealing surface for effecting sealing, or substantial sealing, of fluid communication between the housing passage and the fluid responsive surface; and a valve actuator, wherein the valve actuator includes a squib configured to effect generation of an explosion, in response to sensing of the actuating signal by the sensor, with effect that a change in condition of the valve is effected such that the communication sealing surface becomes displaceable relative to the housing such that fluid communication between the housing passage and the fluid responsive surface is establishable.

39. The flow control apparatus as claimed in claim 38;

wherein the housing passage, the valve, and the fluid responsive surface are co-operatively configured such that, while the communication sealing surface is displaceable relative to the housing, displacement of the communication sealing surface, for establishing the fluid communication between the housing passage and the fluid responsive surface, is effectible in response to urging of the communication sealing surface by fluid disposed within the housing passage.

40. The flow control apparatus as claimed in claim 38;

wherein:

the change in condition of the valve is from a sealing condition to a fluid communication-effectible condition;

the valve includes a coupler that interacts with the housing such that, while the valve is in the sealing condition, the valve is coupled to the housing such that the communication sealing surface is effecting sealing, or substantially sealing, of fluid communication between the housing passage and the fluid responsive surface; and the change in condition includes at least a weakening of at least a portion of the valve.

41. The flow control apparatus as claimed in claim 40;

wherein the valve and the housing passage are co-operatively configured such that, while the at least a portion of the valve is weakened, the valve is conditioned for fracturing in response to a force being applied by a fluid, disposed within the housing passage, to the weakened portion of the valve.

42. The flow control apparatus as claimed in claim 41;

wherein the conditioning of the valve is such that, upon fracturing, the displacement of the communication sealing surface is effected such that the fluid communication becomes established between the housing passage and the fluid responsive surface.

43. The flow control apparatus as claimed in claim 41;

wherein the valve and the housing passage are co-operatively configured such that, in response to the fracturing of the valve, the communication sealing surface becomes displaceable such that, in response to a force applied by fluid disposed within the housing passage, the communication sealing surface is displaced such that the fluid communication becomes established between the housing passage and the fluid responsive surface.

44. The flow control apparatus as claimed in claim 40;

wherein the at least a weakening of at least a portion of the valve includes fracturing of the valve.

45. The flow control apparatus as claimed in claim 44;

wherein the valve and the housing passage are co-operatively disposed such that, in response to the fracturing of the valve, the communication sealing surface becomes displaceable such that, in response to a force applied by fluid disposed within the housing passage, the communication sealing surface is displaced such that the fluid communication between the housing passage and the fluid responsive surface becomes established.

46. The flow control apparatus as claimed in claim 38;

wherein the valve and the valve actuator are defined by an exploding bolt, such that the flow control apparatus comprises the exploding bolt.

47. A process for supplying fluid to a subterranean formation via a flow controller disposed within a wellbore, comprising:

transmitting an actuating signal into the subterranean formation;

sensing the actuating signal with a sensor disposed within the wellbore;

actuating an energetic device in response to the sensed actuating signal, with effect that an explosion is generated, and, in response to the generated explosion, fluid pressure communication is effected between a flow controller and a source of fluid pressure; and communicating fluid pressure, via the fluid pressure source, to the flow controller, with effect that flow communication is established between the wellbore and the subterranean formation; and after the establishing of the flow communication between the wellbore and the subterranean formation, supplying fluid, via the wellbore, into the subterranean formation.

48. The process as claimed in claim 47;

wherein the communicating fluid pressure is with effect that occlusion to flow communication, by the flow controller, is defeated.

49. The process as claimed in claim 47;

wherein:

the communication of the fluid pressure is with effect that the flow controller is displaced relative to a flow communicator; and the effected flow communication is via the flow communicator.

50. A flow control apparatus comprising:

a housing including a housing passage;

a port extending through the housing;

a flow control member including a fluid responsive surface, and configured for displacement, relative to the port;

a sensor for sensing an actuating signal;

a valve; and a valve actuator, wherein the valve actuator includes an energetic device configured for effecting generation of an explosion, in response to the sensing of an actuating signal by the sensor, with effect that a change in condition of the valve is effected such that fluid communication between the housing passage and the fluid responsive surface is effected.

51. The flow control apparatus as claimed in claim 50; wherein the valve is biased for effecting sealing, or substantial sealing, of fluid communication between the housing passage and the fluid responsive surface.

52. The flow control apparatus as claimed in claim 51, further comprising:
a resilient member;
wherein the biasing is effected by the resilient member.

53. The flow control apparatus as claimed in claim 50; wherein:
the valve is displaceable relative to the housing; and
the change in condition of the valve, effected by the generated explosion, includes displacement of the valve relative to the housing.

54. The flow control apparatus as claimed in claim 53, further comprising:
a fluid communication passage extending between the housing passage and the fluid responsive surface;
wherein:
the effected displacement of the valve is from a closed position to an open position;
in the closed position, the valve is occluding the fluid communication passage; and
in the open position, the fluid communication between the housing passage and the fluid responsive surface is effected.

55. The flow control apparatus as claimed in claim 54; wherein the valve includes a piston;
and further comprising a piston conducting passage, disposed between the flow control member and the housing, for receiving the displacement of the piston.

56. The flow control apparatus as claimed in claim 55; wherein the piston is biased for effecting sealing, or substantial sealing, of fluid communication between the housing passage and the fluid responsive surface.

57. The flow control apparatus as claimed in claim 50; wherein:
the valve includes a communication sealing surface for effecting sealing, or substantial sealing, of fluid communication between the housing passage and the fluid responsive surface; and
the change in condition of the valve, effected by the generated explosion, includes a change in condition of the communication sealing surface such that fluid communication becomes effected between the housing passage and the fluid responsive surface.

58. The flow control apparatus as claimed in claim 57; wherein:
the valve actuator further includes a cutter; and
the energetic device and the cutter are co-operatively configured such that, in response to the sensing of an actuating signal by the sensor, the energetic device generates an explosion and, in response to the generated explosion, the cutter is urged to puncture the communication sealing surface with effect that the fluid communication between the housing passage and the fluid responsive surface becomes effected.

59. The flow control apparatus as claimed in claim 58; wherein the cutter includes a bayonet.

60. The flow control apparatus as claimed in claim 57, further comprising:
a fluid communication passage extending between the housing passage and the fluid responsive surface, wherein the sealing, or substantial sealing, of fluid communication between the housing passage and the fluid responsive surface, is effected by sealing, or substantial sealing, of the fluid communication passage by the communication sealing surface.

61. The flow control apparatus as claimed in claim 60; wherein
the extending of the fluid communication passage, between the housing passage and the fluid responsive surface, includes extension through the flow control member.

62. The flow control apparatus as claimed in claim 61; wherein:
the valve actuator further includes a cutter; and
the energetic device and the cutter are co-operatively configured such that, in response to the sensing of an actuating signal by the sensor, the energetic device generates an explosion and, in response to the generated explosion, the cutter is urged to puncture the communication sealing surface with effect that the fluid communication between the housing passage and the fluid responsive surface becomes effected.

63. The flow control apparatus as claimed in claim 62; wherein the cutter includes a bayonet.

64. The flow control apparatus as claimed in claim 60; wherein:
the valve actuator further includes a cutter; and
the energetic device and the cutter are co-operatively configured such that, in response to the sensing of an actuating signal by the sensor, the energetic device generates an explosion and, in response to the generated explosion, the cutter is urged to puncture the communication sealing surface with effect that the fluid communication between the housing passage and the fluid responsive surface becomes effected.

65. The flow control apparatus as claimed in claim 64; wherein the cutter includes a bayonet.

66. The flow control apparatus as claimed in claim 50; wherein the housing passage, and the flow control member are co-operatively configured such that, while pressurized fluid is disposed within the housing passage, and the fluid communication between the housing passage and the flow control member is effected, the displacement of the flow control member is urged by the pressurized fluid.

67. The flow control apparatus as claimed in claim 66, further comprising:
a fluid communication passage extending between the housing passage and the fluid responsive surface, wherein the sealing, or substantial sealing, of fluid communication between the housing passage and the fluid responsive surface, is effected by sealing, or substantial sealing, of the fluid communication passage by the communication sealing surface.

68. The flow control apparatus as claimed in claim 67; wherein
the extending of the fluid communication passage, between the housing passage and the fluid responsive surface, includes extension through the flow control member.

69. The flow control apparatus as claimed in claim 68; wherein:
the valve actuator further includes a cutter; and
the energetic device and the cutter are co-operatively configured such that, in response to the sensing of an actuating signal by the sensor, the energetic device generates an explosion and, in response to the generated explosion, the cutter is urged to puncture the communication sealing surface with effect that the fluid communication between the housing passage and the fluid responsive surface becomes effected.

70. The flow control apparatus as claimed in claim 69; wherein the cutter includes a bayonet.

71. The flow control apparatus as claimed in claim 67; wherein:

the valve actuator further includes a cutter; and the energetic device and the cutter are co-operatively configured such that, in response to the sensing of an actuating signal by the sensor, the energetic device generates an explosion and, in response to the generated explosion, the cutter is urged to puncture the communication sealing surface with effect that the fluid communication between the housing passage and the fluid responsive surface becomes effected.

72. The flow control apparatus as claimed in claim 71; wherein the cutter includes a bayonet.

73. The flow control apparatus as claimed in claim 66; wherein:

the valve actuator further includes a cutter; and the energetic device and the cutter are co-operatively configured such that, in response to the sensing of an actuating signal by the sensor, the energetic device generates an explosion and, in response to the generated explosion, the cutter is urged to puncture the communication sealing surface with effect that the fluid communication between the housing passage and the fluid responsive surface becomes effected.

74. The flow control apparatus as claimed in claim 73; wherein the cutter includes a bayonet.

75. A flow control apparatus comprising:

a housing including a housing passage;

a port extending through the housing;

a flow control member including a fluid responsive surface, and configured for displacement, relative to the port;

a sensor for sensing an actuating signal;

a sealed interface; and an actuator, wherein the actuator includes an energetic device configured for generating an explosion for effecting defeating of the sealed interface, in response to the sensing of an actuating signal by the sensor, such that fluid communication between the housing passage and the fluid responsive surface is effected.

76. The flow control apparatus as claimed in claim 75; wherein:

the actuator further includes a cutter; and the energetic device and the cutter are co-operatively configured such that, in response to the sensing of an actuating signal by the sensor, the energetic device generates an explosion and, in response to the generated explosion, the cutter is urged to puncture the sealed interface with effect that the fluid communication between the housing passage and the fluid responsive surface becomes effected.

77. The flow control apparatus as claimed in claim 76; wherein the cutter includes a bayonet.

78. The flow control apparatus as claimed in claim 75, further comprising:

a fluid communication passage extending between the housing passage and the fluid responsive surface, wherein the sealing, or substantial sealing, of fluid communication between the housing passage and the fluid responsive surface, is effected by sealing, or substantial sealing, of the fluid communication passage by the communication sealing surface.

79. The flow control apparatus as claimed in claim 78; wherein the extending of the fluid communication passage, between the housing passage and the fluid responsive surface, includes extension through the flow control member.

80. The flow control apparatus as claimed in claim 79; wherein:

the actuator further includes a cutter; and the energetic device and the cutter are co-operatively configured such that, in response to the sensing of an actuating signal by the sensor, the energetic device generates an explosion and, in response to the generated explosion, the cutter is urged to puncture the sealed interface with effect that the fluid communication between the housing passage and the fluid responsive surface becomes effected.

81. The flow control apparatus as claimed in claim 80; wherein the cutter includes a bayonet.

82. The flow control apparatus as claimed in claim 78; wherein:

the actuator further includes a cutter; and the energetic device and the cutter are co-operatively configured such that, in response to the sensing of an actuating signal by the sensor, the energetic device generates an explosion and, in response to the generated explosion, the cutter is urged to puncture the sealed interface with effect that the fluid communication between the housing passage and the fluid responsive surface becomes effected.

83. The flow control apparatus as claimed in claim 82; wherein the cutter includes a bayonet.

84. The flow control apparatus as claimed in claim 75; wherein the housing passage, and the flow control member are co-operatively configured such that, while pressurized fluid is disposed within the housing passage, and the fluid communication between the housing passage and the flow control member is effected, the displacement of the flow control member is urged by the pressurized fluid.

85. The flow control apparatus as claimed in claim 84, further comprising:

a fluid communication passage extending between the housing passage and the fluid responsive surface, wherein the sealing, or substantial sealing, of fluid communication between the housing passage and the fluid responsive surface, is effected by sealing, or substantial sealing, of the fluid communication passage by the communication sealing surface.

86. The flow control apparatus as claimed in claim 85; wherein the extending of the fluid communication passage, between the housing passage and the fluid responsive surface, includes extension through the flow control member.

87. The flow control apparatus as claimed in claim 86; wherein:

the actuator further includes a cutter; and the energetic device and the cutter are co-operatively configured such that, in response to the sensing of an actuating signal by the sensor, the energetic device generates an explosion and, in response to the generated explosion, the cutter is urged to puncture the sealed interface with effect that the fluid communication between the housing passage and the fluid responsive surface becomes effected.

88. The flow control apparatus as claimed in claim 87; wherein the cutter includes a bayonet.

89. The flow control apparatus as claimed in claim 85; wherein:

the actuator further includes a cutter; and the energetic device and the cutter are co-operatively configured such that, in response to the sensing of an actuating signal by the sensor, the energetic device generates an explosion and, in response to the generated explosion, the cutter is urged to puncture the sealed interface with effect that the fluid communication between the housing passage and the fluid responsive surface becomes effected.

90. The flow control apparatus as claimed in claim 89; wherein the cutter includes a bayonet.

91. The flow control apparatus as claimed in claim 84; wherein:

the actuator further includes a cutter; and the energetic device and the cutter are co-operatively configured such that, in response to the sensing of an actuating signal by the sensor, the energetic device generates an explosion and, in response to the generated explosion, the cutter is urged to puncture the sealed interface with effect that the fluid communication between the housing passage and the fluid responsive surface becomes effected.

92. The flow control apparatus as claimed in claim 91; wherein the cutter includes a bayonet.

* * * * *